US011236911B2

(12) United States Patent
DeYoung

(10) Patent No.: US 11,236,911 B2
(45) Date of Patent: Feb. 1, 2022

(54) PUSH-TO-OPEN/SIGNAL-TO-OPEN APPLIANCE DOOR LATCHING SYSTEM WITH AN INTEGRATED LOCKING DEVICE

(71) Applicant: HTI Technology and Industries, Inc., La Vergne, TN (US)

(72) Inventor: Roger L. DeYoung, Franklin, TN (US)

(73) Assignee: HTI TECHNOLOGY AND INDUSTRIES, INC., La Vergne, TN (US)

( * ) Notice: Subject to any disclaimer, the term of this patent is extended or adjusted under 35 U.S.C. 154(b) by 523 days.

(21) Appl. No.: 16/248,043

(22) Filed: Jan. 15, 2019

(65) Prior Publication Data

US 2019/0219269 A1 Jul. 18, 2019

Related U.S. Application Data

(60) Provisional application No. 62/618,783, filed on Jan. 18, 2018.

(51) Int. Cl.
*F24C 15/02* (2006.01)
*E05C 19/02* (2006.01)
(Continued)

(52) U.S. Cl.
CPC ..... *F24C 15/022* (2013.01); *E05B 47/023* (2013.01); *E05B 47/0603* (2013.01);
(Continued)

(58) Field of Classification Search
CPC .... F25C 15/022; E05C 19/022; E05B 47/023; E05B 47/0603; E05B 2063/0026; Y10S 292/04; Y10S 292/69
(Continued)

(56) References Cited

U.S. PATENT DOCUMENTS 3,462,584 A 8/1969 Guy
4,927,996 A 5/1990 Genbauffe et al.
(Continued)

FOREIGN PATENT DOCUMENTS

CN 207905531 U * 9/2018
CN 109209084 A * 1/2019
(Continued)

OTHER PUBLICATIONS

International Search Report and Written Opinion dated Aug. 4, 2017 for PCT Application No. PCT/US2017/031013 filed on May 4, 2017.

*Primary Examiner* — Kristina R Fulton
*Assistant Examiner* — James Edward Ignaczewski
(74) *Attorney, Agent, or Firm* — Emerson, Thomson & Bennett, LLC; Roger D. Emerson

(57) ABSTRACT

Provided is a push-to-open latch for an oven appliance and other household appliances. The push-to-open latch includes an integrated locking device for locking an appliance door in place and initiate a downstream appliance function such as a self-cleaning function. The integrated locking device includes a rotating cam having a latching slot which engages a pawl. The rotating cam also includes a guiding ramp and a catch surface which may be used to engage a latching finger to lock the cam in place. In addition, the locking device may include a locking slide and a locking slide pin that is actuated by a solenoid to engage the cam. Once the appliance door is locked, one or more switches send a signal to the appliance controller to activate the downstream function.

18 Claims, 38 Drawing Sheets

(51) Int. Cl.
*E05B 47/06* (2006.01)
*E05B 47/02* (2006.01)
*E05B 63/00* (2006.01)

(52) U.S. Cl.
CPC .... *E05C 19/022* (2013.01); *E05B 2063/0026* (2013.01); *F24C 15/028* (2013.01)

(58) Field of Classification Search
USPC ..... 292/201
See application file for complete search history.

(56) References Cited

U.S. PATENT DOCUMENTS

| | | | | |
|---|---|---|---|---|
| 6,302,098 | B1 | 10/2001 | Smith | |
| 6,315,336 | B1 | 11/2001 | Swartzell | |
| 6,698,418 | B2 | 3/2004 | Ramsey et al. | |
| 6,863,316 | B2 | 3/2005 | Cole | |
| 7,040,674 | B2 | 5/2006 | Lomicka et al. | |
| 7,137,387 | B2 | 11/2006 | Edwards | |
| 7,185,925 | B2 | 3/2007 | Courter et al. | |
| 7,364,209 | B2 | 4/2008 | Lomicka et al. | |
| 7,726,294 | B2 | 6/2010 | Collene et al. | |
| 9,335,056 | B1 | 5/2016 | Lomicka et al. | |
| 9,958,167 | B2 | 5/2018 | Lomicka et al. | |
| 10,806,322 | B2 * | 10/2020 | Dirnberger | D06F 37/42 |
| 2003/0080569 | A1 | 5/2003 | Raymond et al. | |
| 2003/0116975 | A1 | 6/2003 | Cole | |
| 2004/0140677 | A1 | 7/2004 | Hengelein et al. | |
| 2005/0284464 | A1 | 12/2005 | Edwards et al. | |
| 2006/0208502 | A1 * | 9/2006 | Parent | E05B 81/14 292/216 |
| 2008/0030028 | A1 | 2/2008 | Heid et al. | |
| 2008/0169657 | A1 * | 7/2008 | Horton | E05B 83/30 292/220 |
| 2017/0145613 | A1 * | 5/2017 | Choi | E05B 17/2007 |
| 2018/0371806 | A1 * | 12/2018 | Jeong | E05B 81/14 |
| 2019/0017216 | A1 * | 1/2019 | Dirnberger | E05B 63/0056 |
| 2019/0316400 | A1 * | 10/2019 | Shin | F24C 15/022 |

FOREIGN PATENT DOCUMENTS

| | | | | |
|---|---|---|---|---|
| CN | 112112500 | A * | 12/2020 | |
| DE | 202012005738 | U1 * | 9/2013 | E05B 63/0056 |
| EP | 2840208 | A1 * | 2/2015 | D06F 39/14 |
| WO | WO-2010056062 | A2 * | 5/2010 | E05C 19/022 |

* cited by examiner

PUSH-TO-OPEN/SIGNAL-TO-OPEN APPLIANCE DOOR LATCHING SYSTEM WITH AN INTEGRATED LOCKING DEVICE

I. BACKGROUND

A. Technical Field

This present disclosure generally relates to a push-to-open oven door latching system having an integrated locking device for self-cleaning operations and other features.

B. Description of Related Art

Traditional construction and management of an oven door for an oven cooking appliance incorporates a pivoting hinge at one end (bottom or side) and a pull-handle at the opposite end (top or opposite side) of the door to provide a user with a means for pulling the door open. Hinge systems on traditional oven doors also have biasing springs and cam detents to hold the door in a closed position. In recent years, some manufacturers have incorporated a push-to-open door latch that requires the user to push the oven door closed to activate the latching function of the push-to-open latch when it is desired to place the door in a closed position. The push-to-open latch also requires that the user conversely push in the oven door near the push-to-open latch to release the door to an open position. Push-to-open latches typically incorporate gas or mechanical springs into the hinge system provide forced motion at a regulated speed to control the door opening. Thus, the incorporation of a push-to-open latch in an oven eliminates the need for an oven door handle. Appliances which do not have handles have become a desired feature among consumers as it allows kitchens to be designed with appliances that are smoothly blended into the kitchen cabinetry.

Another feature of food cooking ovens is that they typically have a self-cleaning function. The self-cleaning function heats the oven to a high temperature for a period of time (typically 3-5 hours) to burn-off organic food residues that have accumulated on inner surfaces of the oven cavity. Self-cleaning temperatures significantly exceed normal cooking temperatures and thus create a burn or fire risk to users during the self-cleaning cycle. To protect users from personal injury or fire risks, oven appliance manufacturers incorporate a door locking device that prevents the oven door from opening during the self-clean cycle and for a period of cooling after the self-clean cycle until the oven temperature has cooled to a safe level.

Self-cleaning ovens equipped with push-to-open latches currently require a separate latching device for the self-clean function. What is therefore needed is a push-to-open oven door latch with an integrated self-cleaning locking device.

II. SUMMARY

Provided is a push-to-open/signal-to-open latching and integrated locking system for a door connected to an appliance. The push-to-open latching and integrated locking system includes an appliance door supported on an appliance by a hinge, wherein the appliance door may be adjusted between an open position and a closed position to allow access to an appliance cavity and wherein the appliance door includes a pawl; a push-to-open latch/signal-to-open and locking device connected to the appliance which is capable of engaging the pawl on the appliance door, a controller which is electrically connected to the push-to-open/signal-to-open latch and locking device; wherein the push-to-open/signal-to-open latch and locking device includes: a latch mounting bracket comprising a flat planar surface and a vertical side edge; a carriage frame connected to the flat planar surface of the latch mounting bracket, wherein the carriage frame comprises a bottom surface, a side surface, a top surface having a top end and a bottom end; a rotating cam having an exterior surface connected to the latch mounting bracket and rotatable with respect to the latching mounting bracket, wherein the rotating cam includes: a latching slot integrated within the exterior surface for engaging the pawl; a guiding ramp on the exterior surface of the rotating cam; a catch surface; and, a secondary ramp, a latching finger having a first end which is attached to the carriage frame and a second end having a projection, wherein the second end of the latching finger is capable of being lifted by the secondary ramp upon rotation of the rotating cam in a first direction when a user engages the rotating cam with the pawl, wherein complete rotation of the rotating cam in the first direction results in the secondary ramp engaging the catch surface of the rotating cam, wherein the latching finger may be released from the catch surface by a user pushing in the appliance door near the push-to-open/signal-to-open latch to induce rotation of the rotating cam in a second opposite direction, wherein rotation of the rotating cam in the second direction guides the latching finger to the secondary ramp and results in lifting the latching finger to release the latching finger from the catch surface.

According to certain aspects of the present disclosure, the push-to-open/signal-to-open latching and integrated locking system includes: a linear solenoid positioned on the bottom surface of the carriage frame adjacent to the rotating cam; a locking slide positioned on the bottom end of the top surface of the carriage frame; slots within the top surface of the carriage frame which allow the locking slide to travel between a retracted position and an extended position lock-on position; a locking pin extending downward from the locking slide between the solenoid and the rotating cam; a locking slot integrated within the exterior surface of the rotating cam, wherein activation of the solenoid induces a force upon the locking slide causing the locking slide to travel to the lock-on position within the slot and causing the locking slide pin to engage the locking slot of the rotating cam.

According to certain aspects of the present disclosure, the push-to-open/signal-to-open latching and integrated locking system includes a pivoting toggle connected to the locking slide, wherein the pivoting toggle may alternately toggle between a lock-on position and a lock-off position with linear movement of the locking slide between the retracted position and the extended position.

According to certain aspects of the present disclosure, the pivoting toggle is supported by a pivot support which is rigidly attached to the carriage frame.

According to certain aspects of the present disclosure, the push-to-open/signal-to-open latching and integrated locking system includes the locking slide includes toggle guide surfaces which direct movement of the pivoting toggle and two crescent niches to engage the toggle leg and hold the locking slide in lock-on and lock-off positions.

According to certain aspects of the present disclosure, the push-to-open/signal-to-open latching and integrated locking system includes a rotating cam switch and a locking slide switch which are independently actuated by a rotating cam ramp integrated within an exterior planar surface of the rotating cam and a locking slide ramp integrated within the locking slide.

According to certain aspects of the present disclosure, the locking slide switch provides a position detection of the locking slide to the appliance controller. This position detection provides the controller with position logic that permits signal-to-open or self-clean functions to commence.

According to certain aspects of the present disclosure, the push-to-open/signal-to-open latching, the rotating cam switch provides a position signal to the controller when the door is closed.

According to certain aspects of the present disclosure, the locking slide switch provides a position signal to the controller that the door is securely locked upon movement of the locking slide within the locking slot of the rotating cam.

According to certain aspects of the present disclosure, the rotating cam switch controls operation of a light within an interior cavity of the appliance when the door is opened or closed by the user.

According to certain aspects of the present disclosure, the rotating cam switch, locking slide switch and linear solenoid each include electrical terminals which are connected to a wiring harness.

According to certain aspects of the present disclosure, the locking slide includes a slide biasing spring which is compressed within the slide against a flange attached to the carriage frame and controls the position of both the pivoting toggle and the locking pin.

According to certain aspects of the present disclosure, the electrical terminals of the rotating cam switch, the locking slide switch and the linear solenoid are contained within a corresponding guiding sleeve.

According to certain aspects of the present disclosure, the guiding sleeve includes protruding chamfered edges to align and ease installation of a mating wire harness connector onto the grouped terminals of the rotating cam switch and the locking slide switch.

According to certain aspects of the present disclosure, the push-to-open/signal-to-open latching and integrated locking system includes a signal-to-open solenoid for deactivating the latching finger, wherein the solenoid is connected to a linear plunger having a first end towards the solenoid and a second end away from the solenoid, wherein the solenoid is capable of adjusting the linear plunger to an extended position and a retracted position, wherein the linear plunger is surrounded by a return spring which assists in pulling the linear plunger to the retracted position and wherein the linear plunger is connected to a pivoting cam wherein the pivoting cam comprises a first end connected to the linear plunger and a second end in contact with the latching finger.

According to certain aspects of the present disclosure, the second end of the linear solenoid is connected to a connecting slot having a first side and a second side, wherein the first end of the pivoting cam comprises a slot formed within the interior portion of the first end of the pivoting cam, wherein the connecting slot and the first end of the pivoting cam are transversely oriented with respect to each other along an axis line, wherein the first side of the connecting slot and the second side of the connecting slot comprises an aperture for receiving a pin, wherein the connecting slot and the first end of the pivoting cam are connected to each other to form a linked connection by a pin which is inserted through the aperture on the first side of the connecting slot, through the slot within the first end of the pivoting cam and through the aperture on the second side of the connecting slot.

According to certain aspects of the present disclosure, the second end of the pivoting cam includes a sloped surface opposite the first end of the pivoting cam wherein the sloped surface at the second end of the pivoting cam lifts the latching finger away from the catch surface as the linear plunger extends to rotate the pivoting cam to dislodge the latching finger from the latching cam.

According to certain aspects of the present disclosure, operation of the linear solenoid is controlled automatically by the controller of the appliance upon completion of an appliance function whereas the operation of the signal-to-open latch is controlled by an operator through a control signal initiated by an operator by engaging a button on a control panel of the appliance or by a voice or motion activation system According to certain aspects of the present disclosure, the push-to-open/signal-to-open latching and integrated locking system includes a manual override cam, wherein the manual override cam is pivotally affixed to a pivot pin at a first end and comprises a slot at a second end opposite of the first end guided by a slot pin and a sloped surface at the second end adjacent to the slot, wherein the sloped surface engages the locking slide pin to induce linear movement of the locking slide pin as the manual override cam rotates causing the locking slide pin to move out from the locking slide slot of the rotating cam to unlock the system and allow the push-to-open latch and signal-to-open solenoid to operate.

According to certain aspects of the present disclosure, the manual override cam is affixed to the top surface of the carriage frame by the pins at the first end and the second end of the manual override cam.

According to certain aspects of the present disclosure, the manual override cam includes a curved surface at its front end, wherein access to the curved surface is provided by a slot within the frame, door or body of the appliance, wherein an operator by contact the curved surface by inserting an object within the frame, door or body of the appliance to cause the manual override cam to rotate to release the locking sliding pin from the locking sliding slot of the rotating cam.

According to certain aspects of the present disclosure, the sliding lock function keeps the oven door locked during the non-cooking self-clean function.

III. BRIEF DESCRIPTION OF THE DRAWINGS

IV. DETAILED DESCRIPTION

Figure 1:
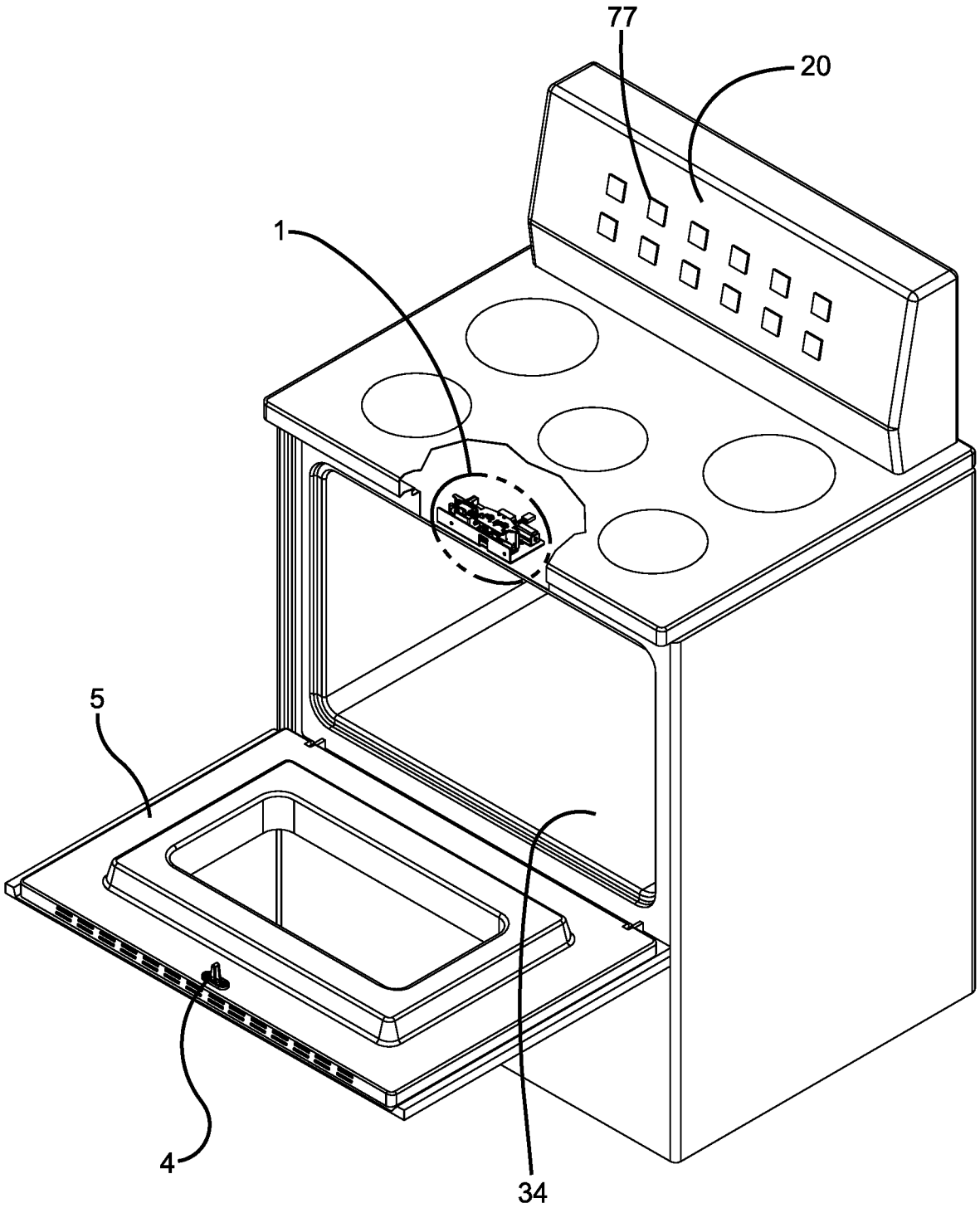
FIG. 1 is a perspective view of an oven appliance having a push-to-open/signal-to-open latching system with an integrated locking device.
Figure 2:
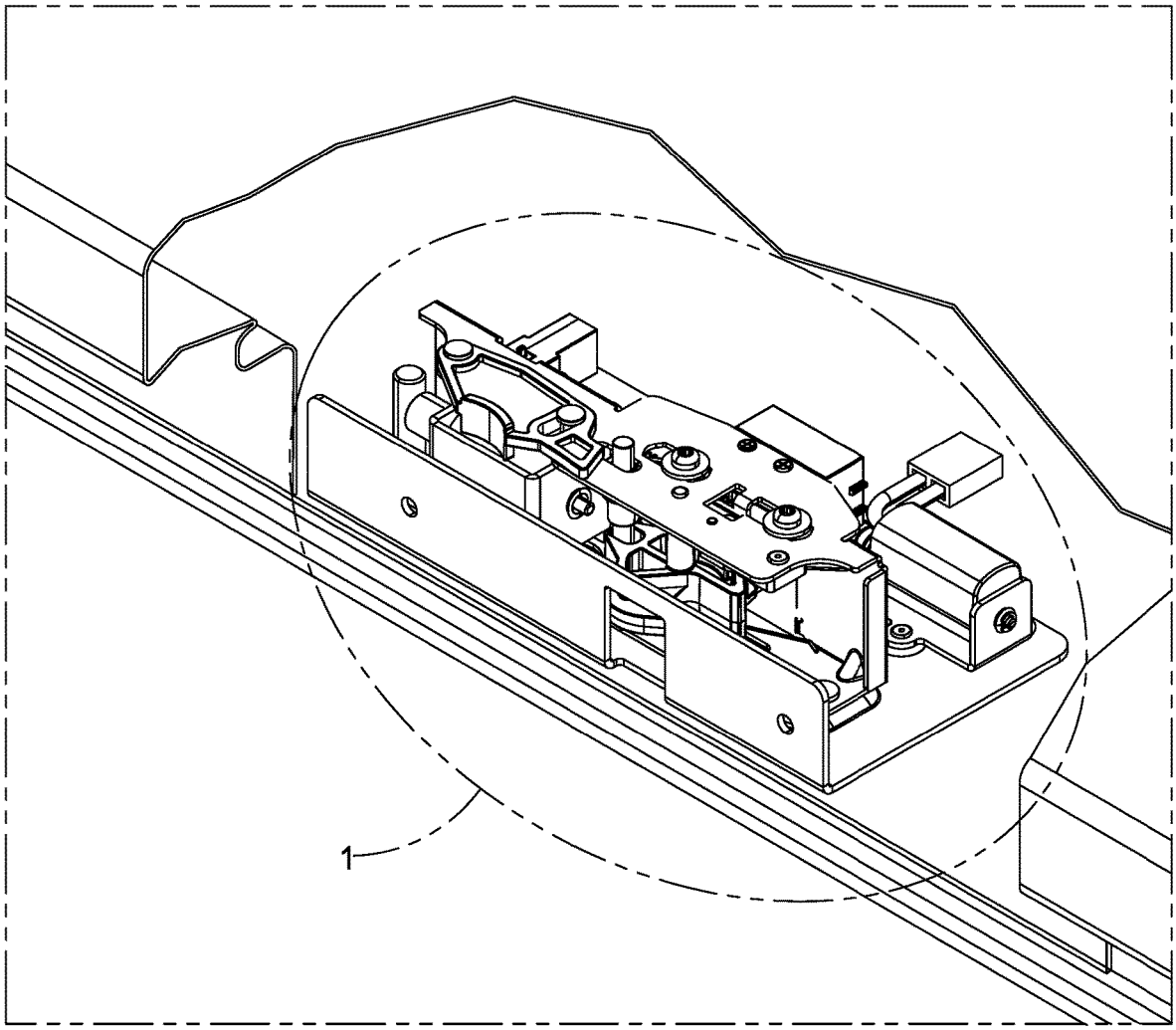
FIG. 2 is a perspective view of the push-to-open/signal-to-open latching system and integrated locking device.
Figure 3:
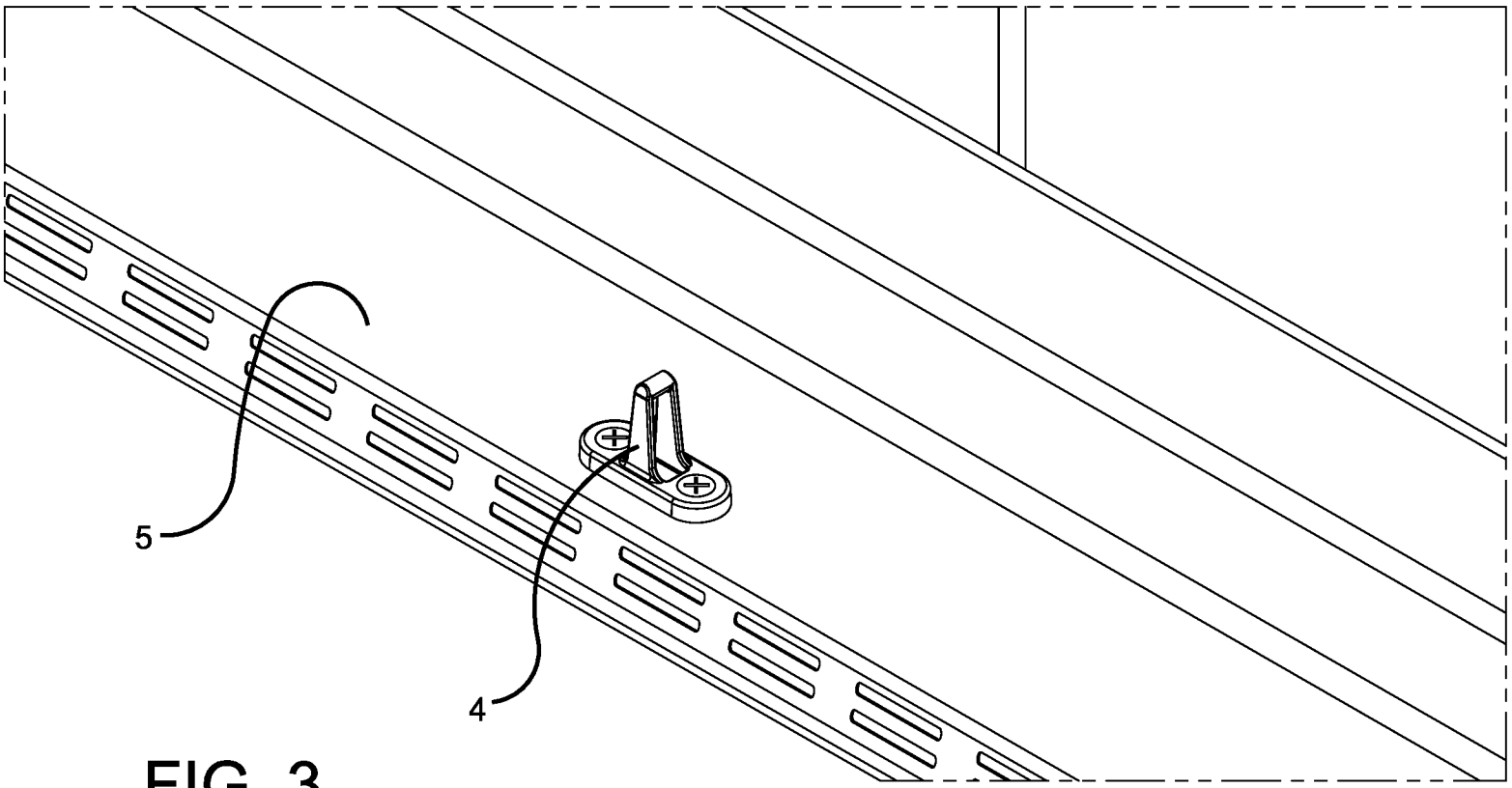
FIG. 3 is a perspective view of a pawl attached to the inner surface of an oven door.
Figure 4:
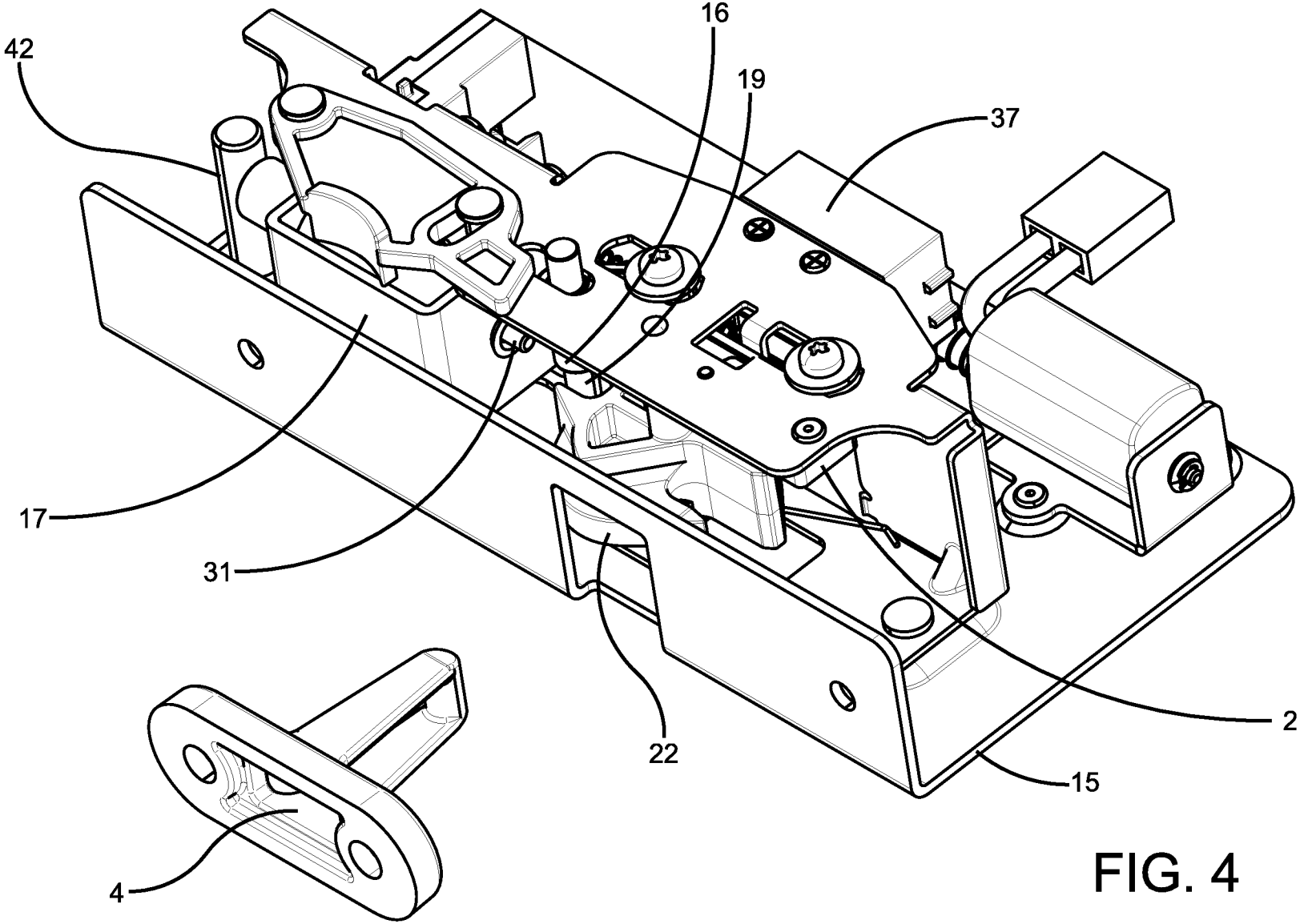
FIG. 4 is a perspective view of the push-to-open/signal-to-open latching system and integrated locking device.
Figure 5:
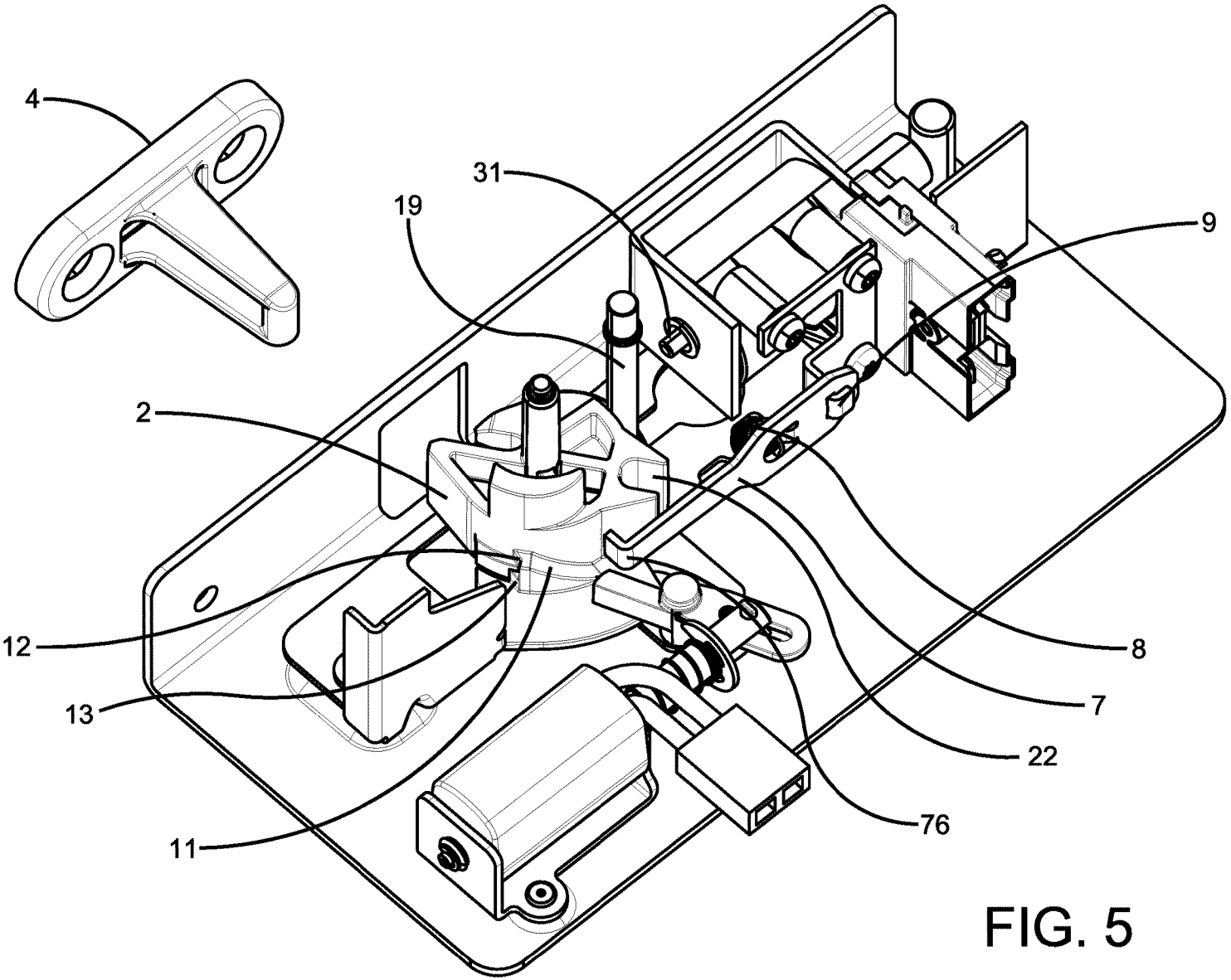
FIG. 5 is a perspective cut away view of the push-to-open/signal-to-open latching system and integrated locking device.
Figure 6:
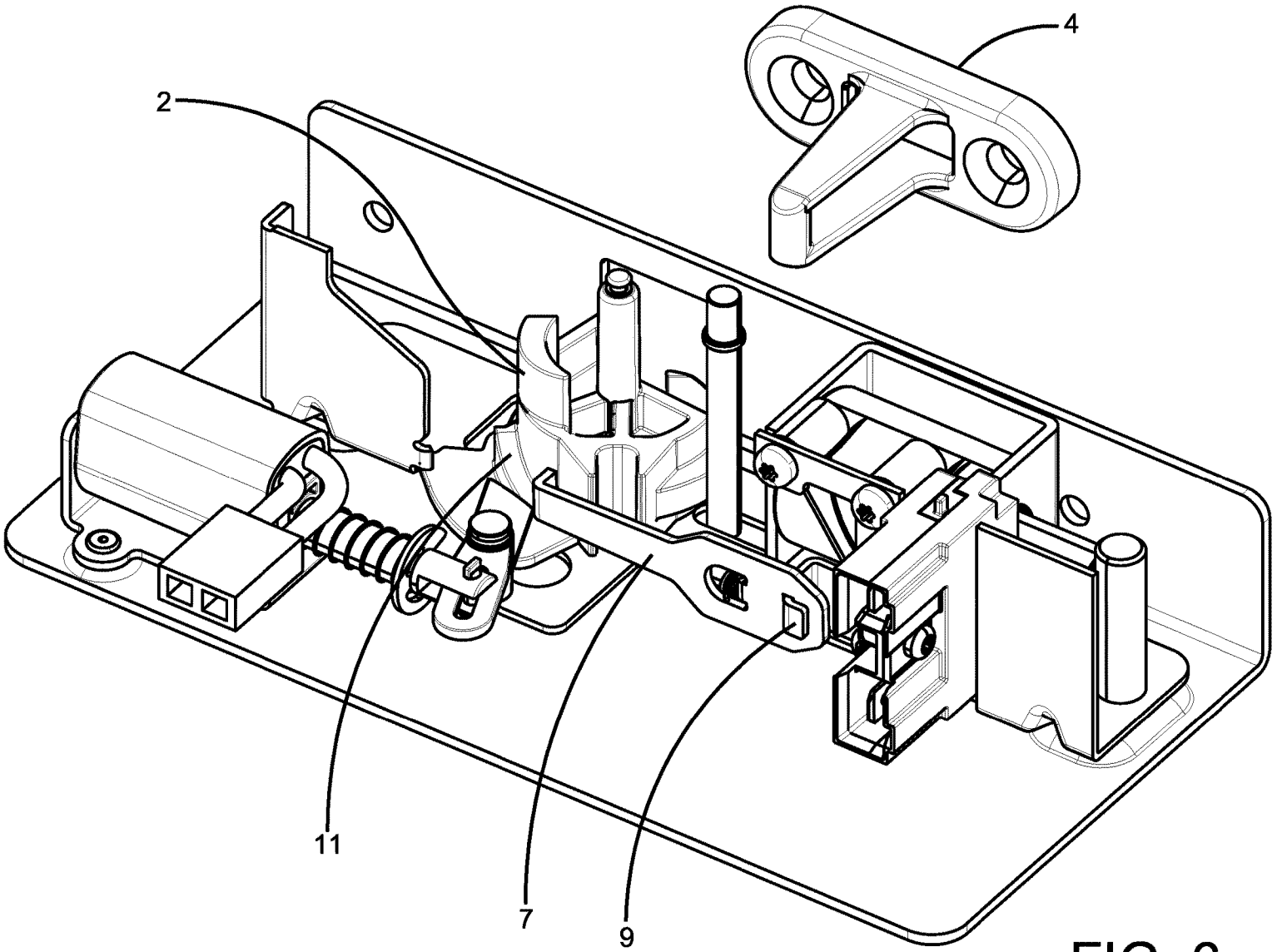
FIG. 6 is a perspective cut away view of the push-to-open/signal-to-open latching system and integrated locking device.
Figure 7:
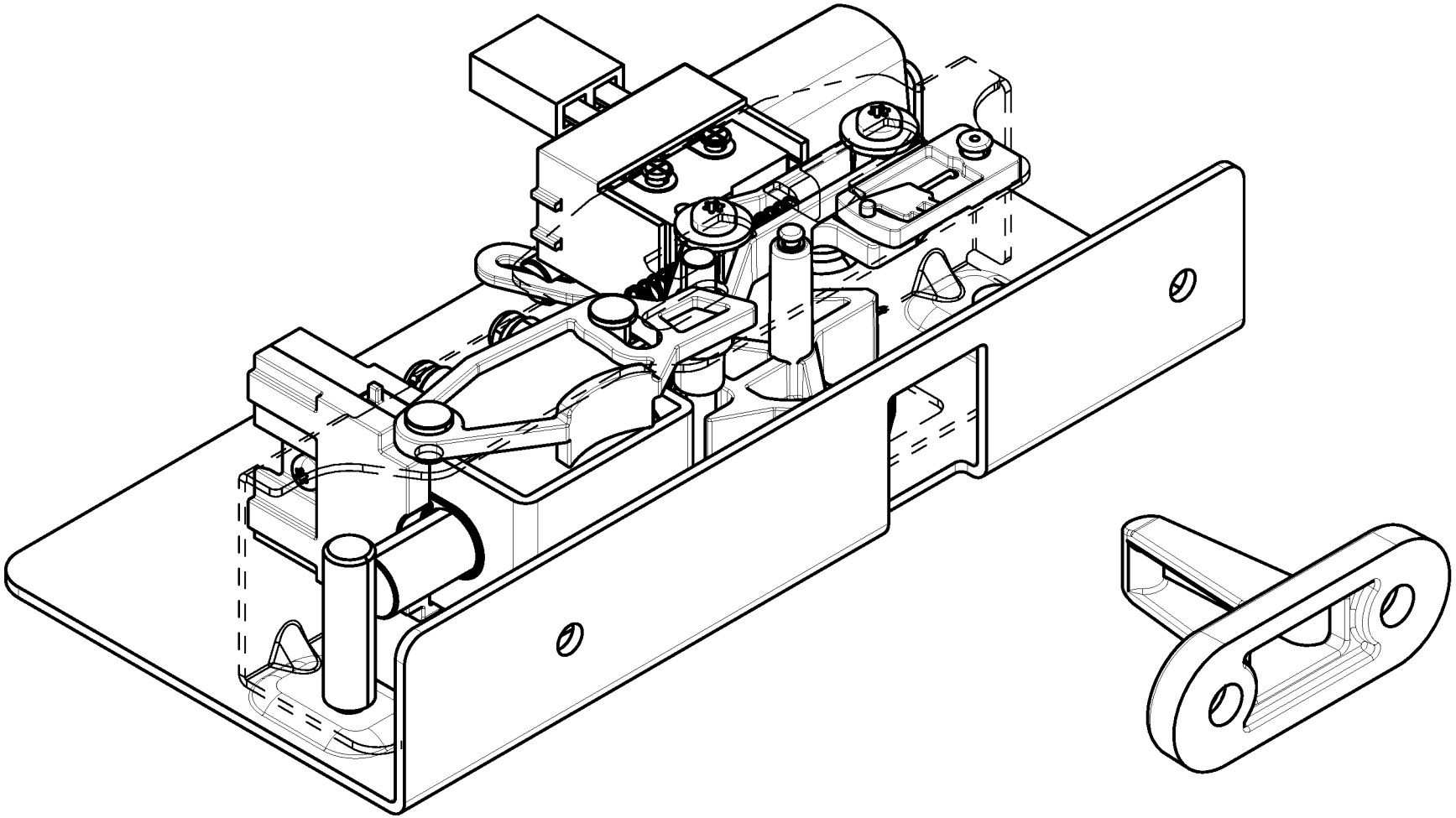
FIG. 7 is a perspective view of the push-to-open/signal-to-open latching system and integrated locking device in an open configuration.
Figure 8:
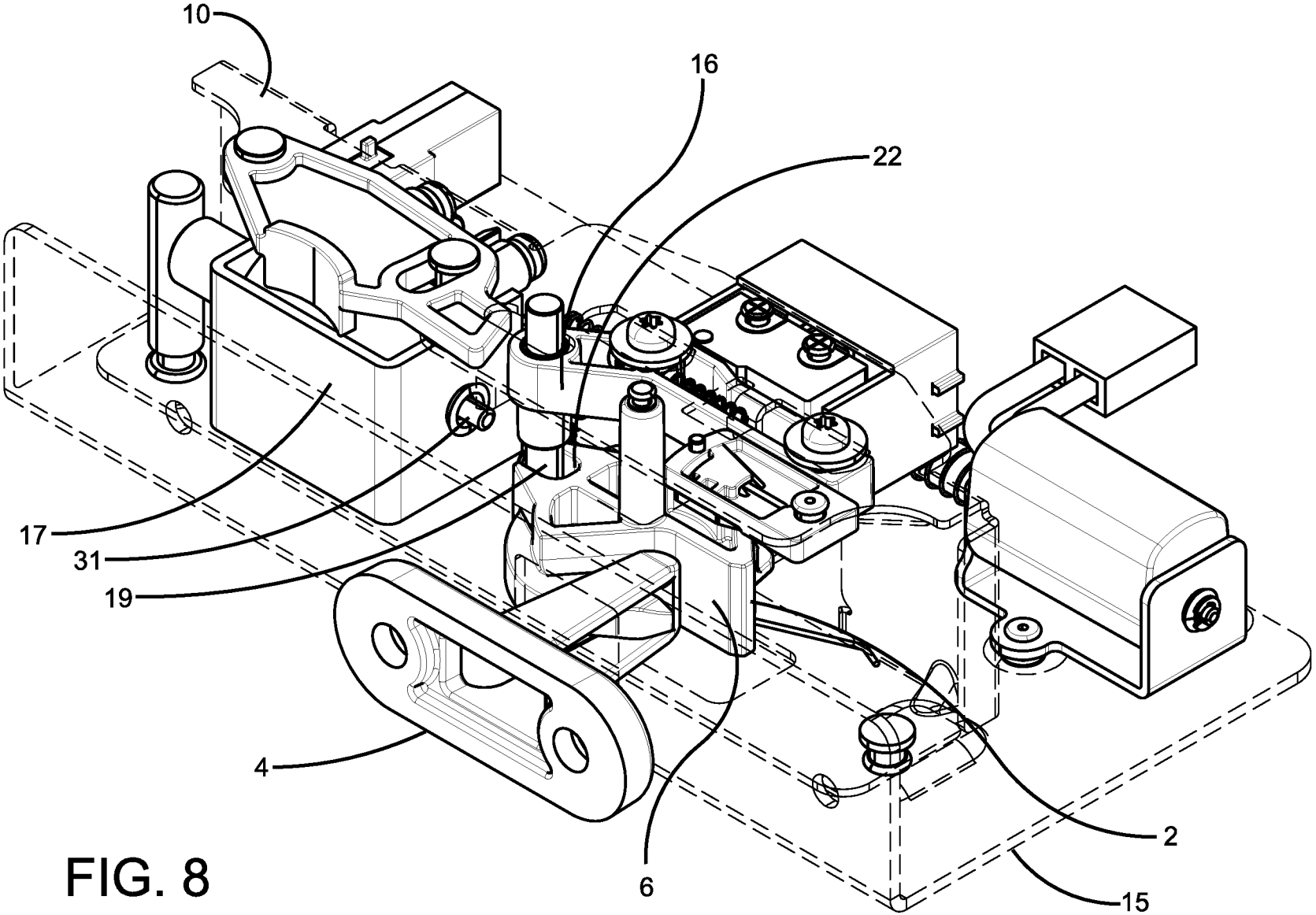
FIG. 8 is a perspective view of the push-to-open/signal-to-open latching system and integrated locking device in a closed configuration.
Figure 9:
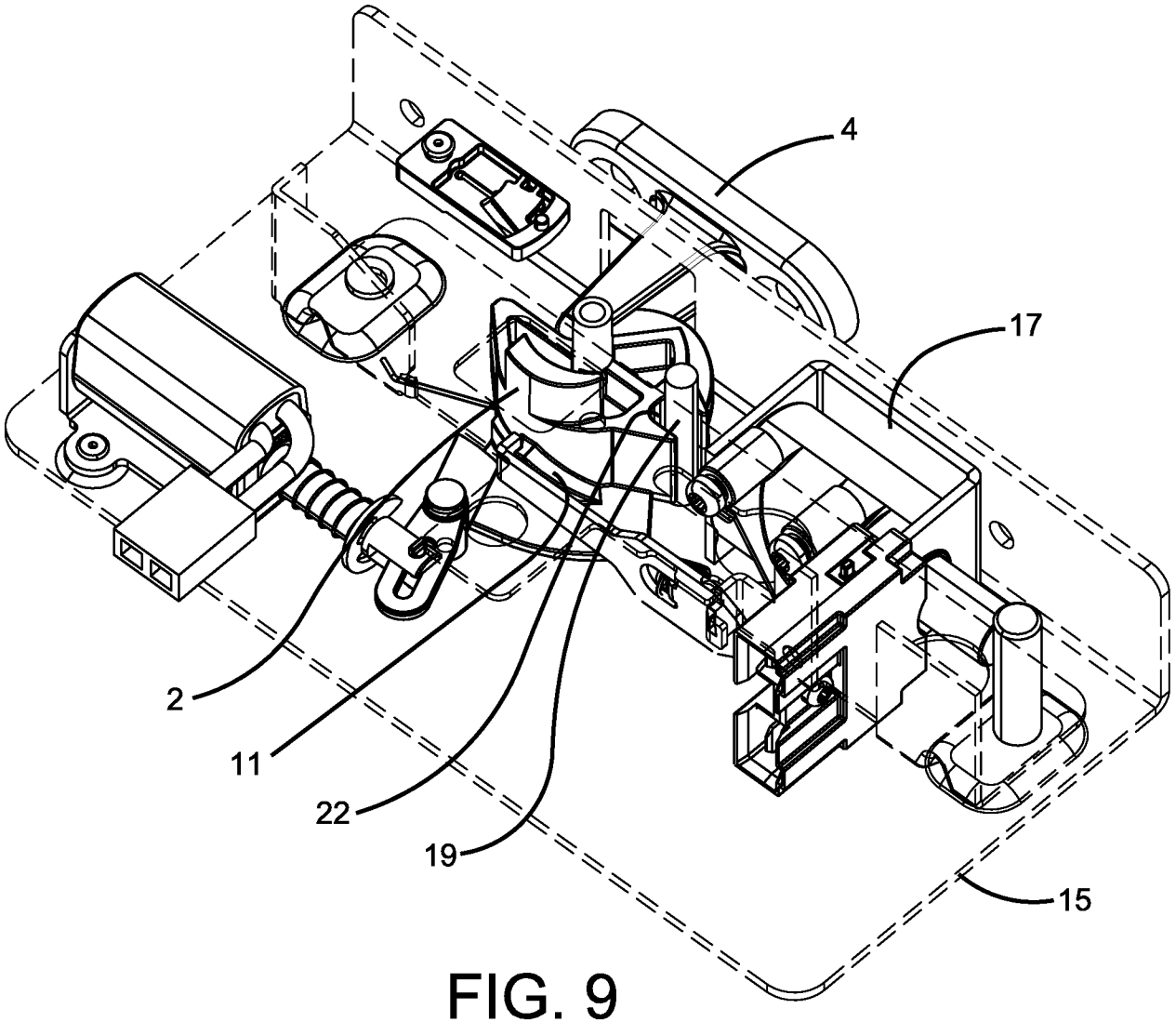
FIG. 9 is a perspective cut away view of the push-to-open/signal-to-open latching system and integrated locking device in a closed configuration.
Figure 10:
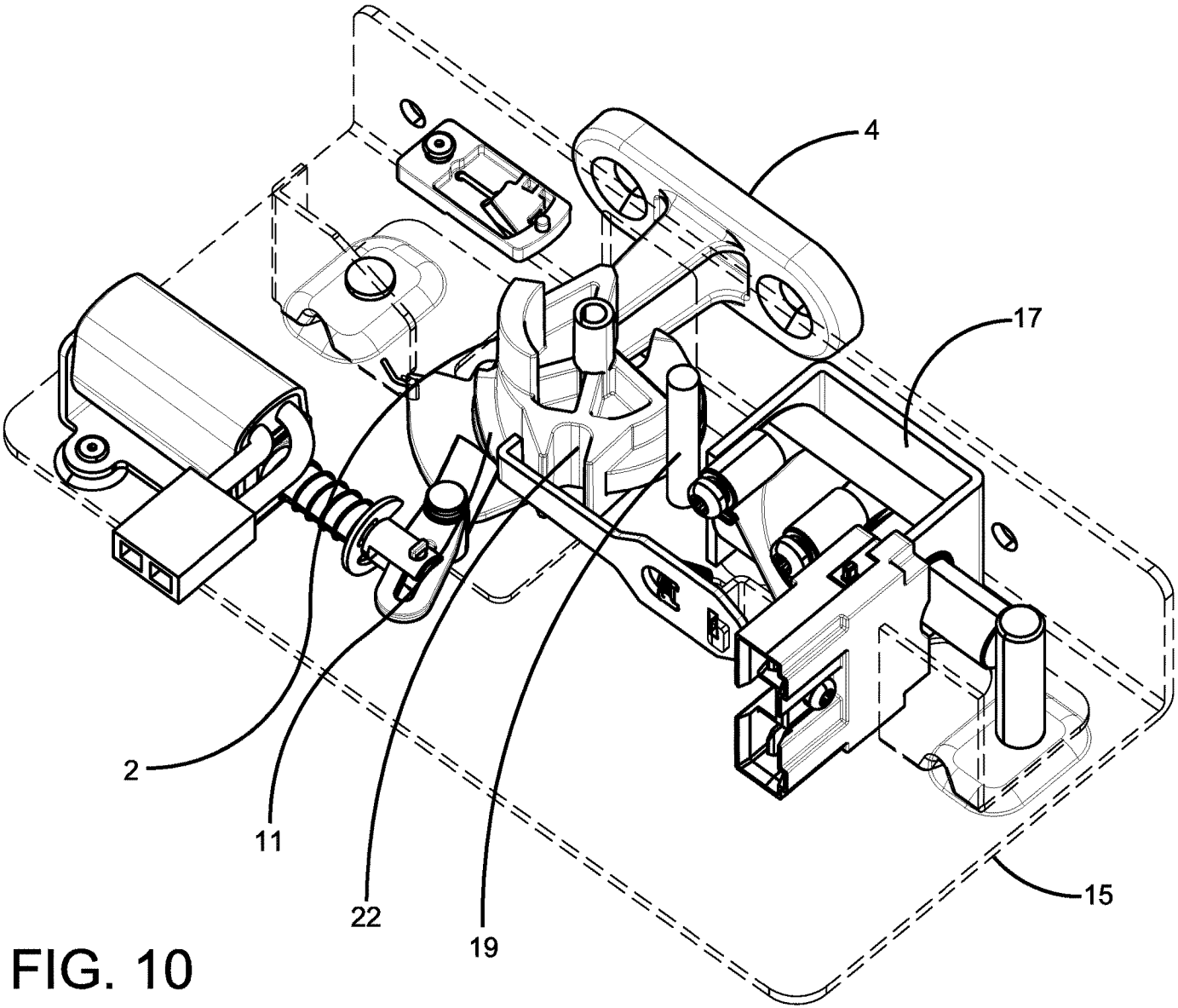
FIG. 10 is a perspective cut away view of the push-to-open/signal-to-open latching system and integrated locking device in an open configuration.
Figure 11:
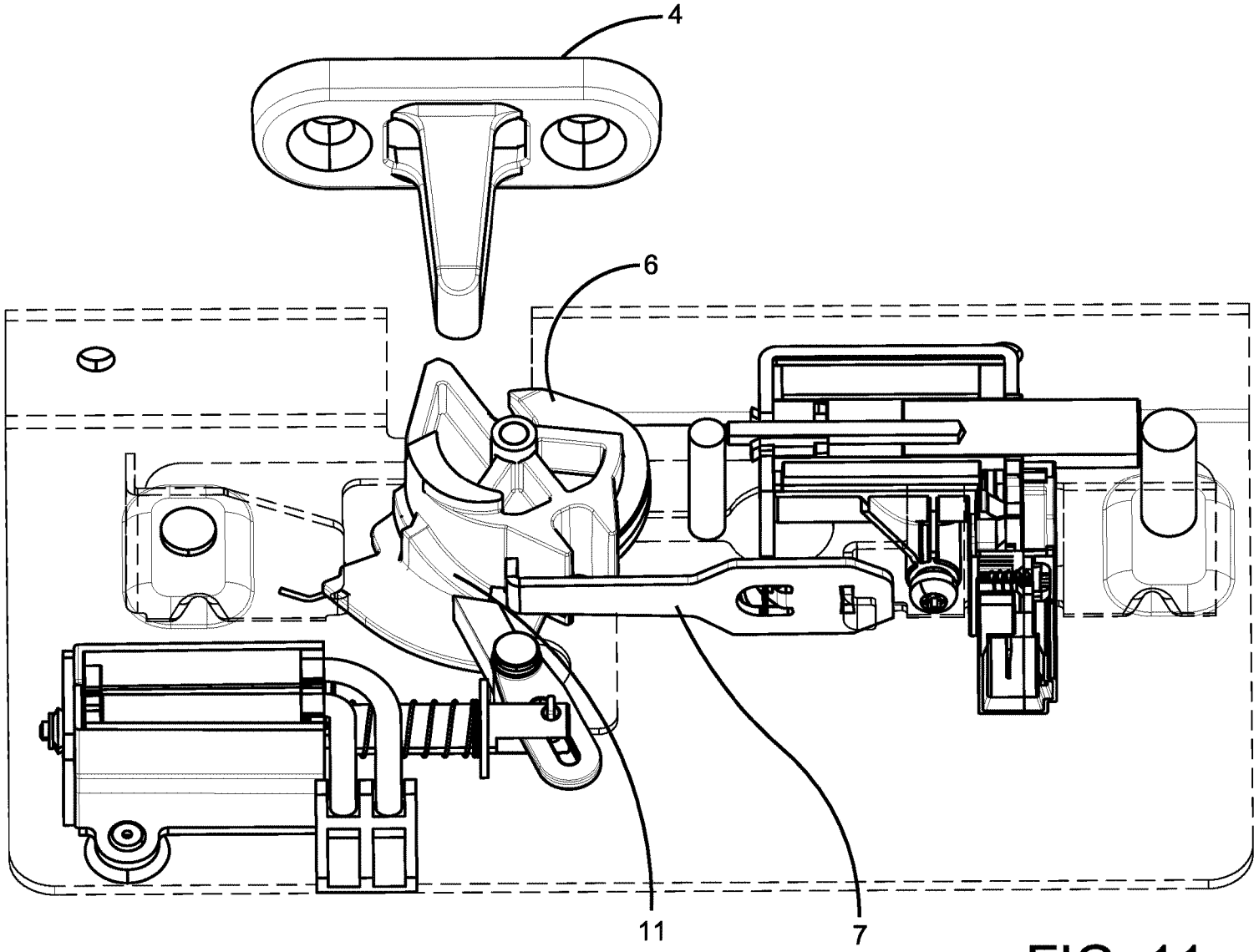
FIG. 11 is a perspective cut away view of the push-to-open/signal-to-open latching system and integrated locking device in an open configuration.
Figure 12:
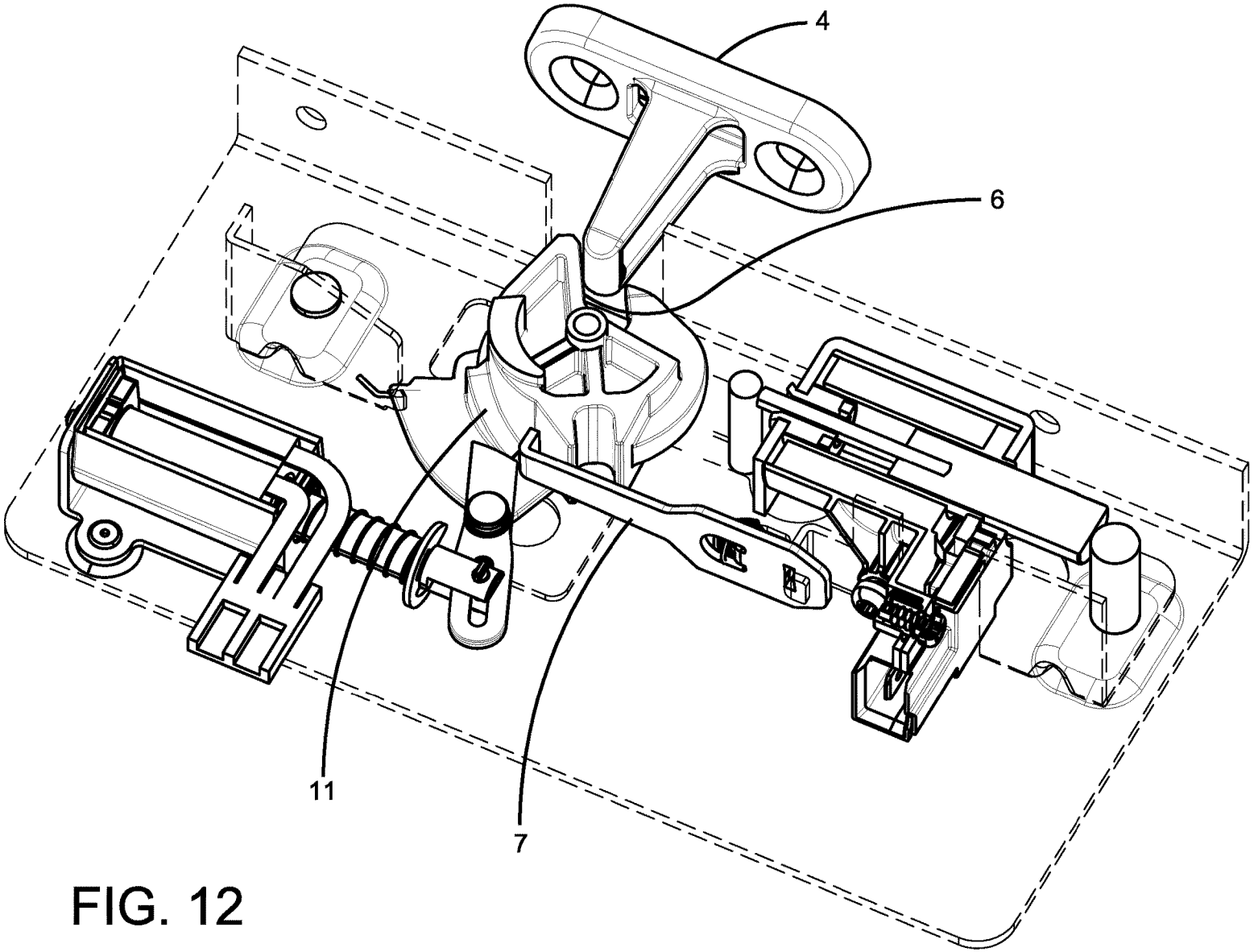
FIG. 12 is a perspective cut away view of the push-to-open/signal-to-open latching system and integrated locking device in an open configuration.
Figure 13:
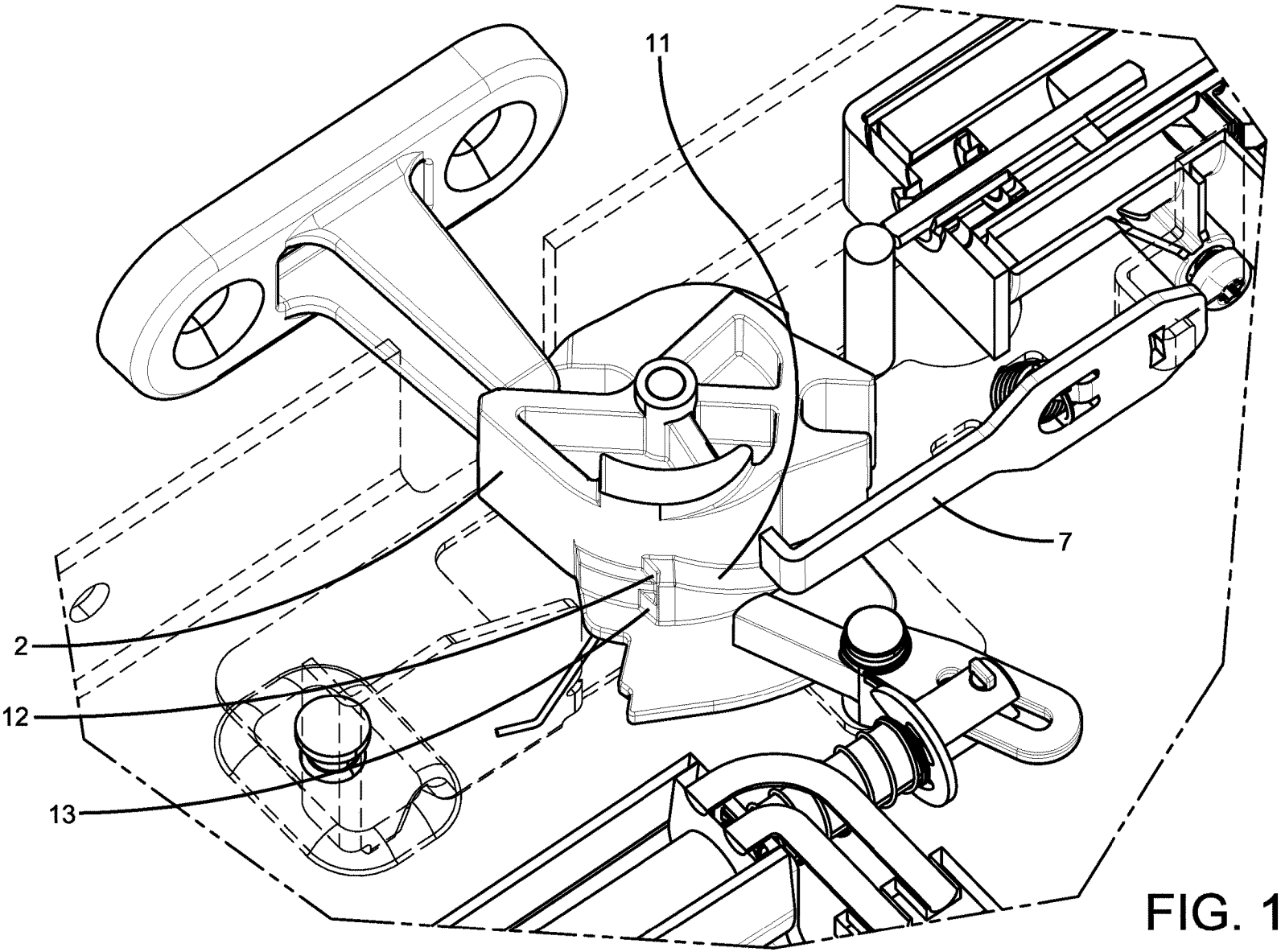
FIG. 13 is a perspective cut away view of a portion of the push-to-open/signal-to-open latching system and integrated locking device in an open configuration.
Figure 14:
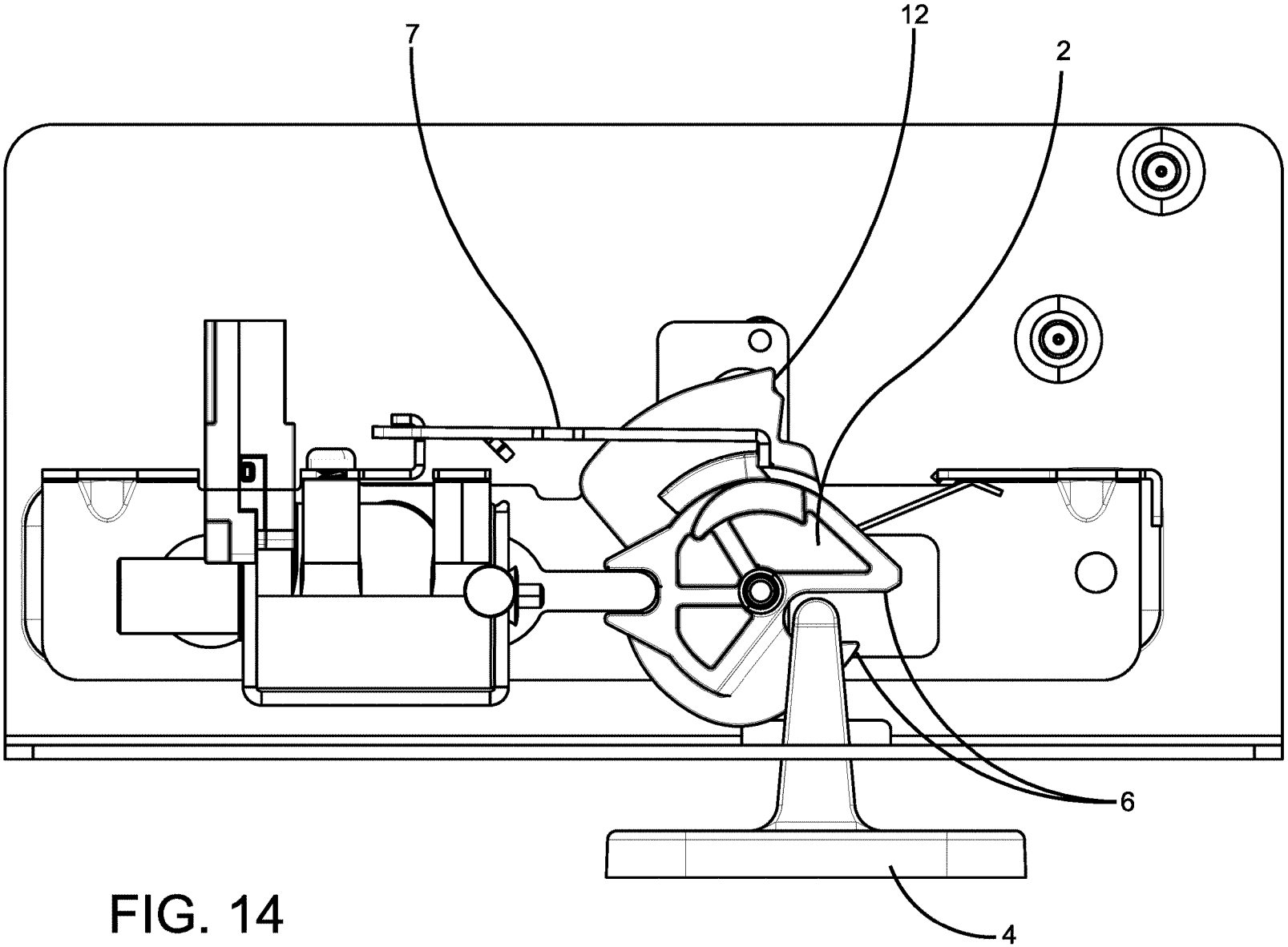
FIG. 14 is a top cut away view of the push-to-open/signal-to-open latching system and integrated locking device in a closed configuration.
Figure 15:
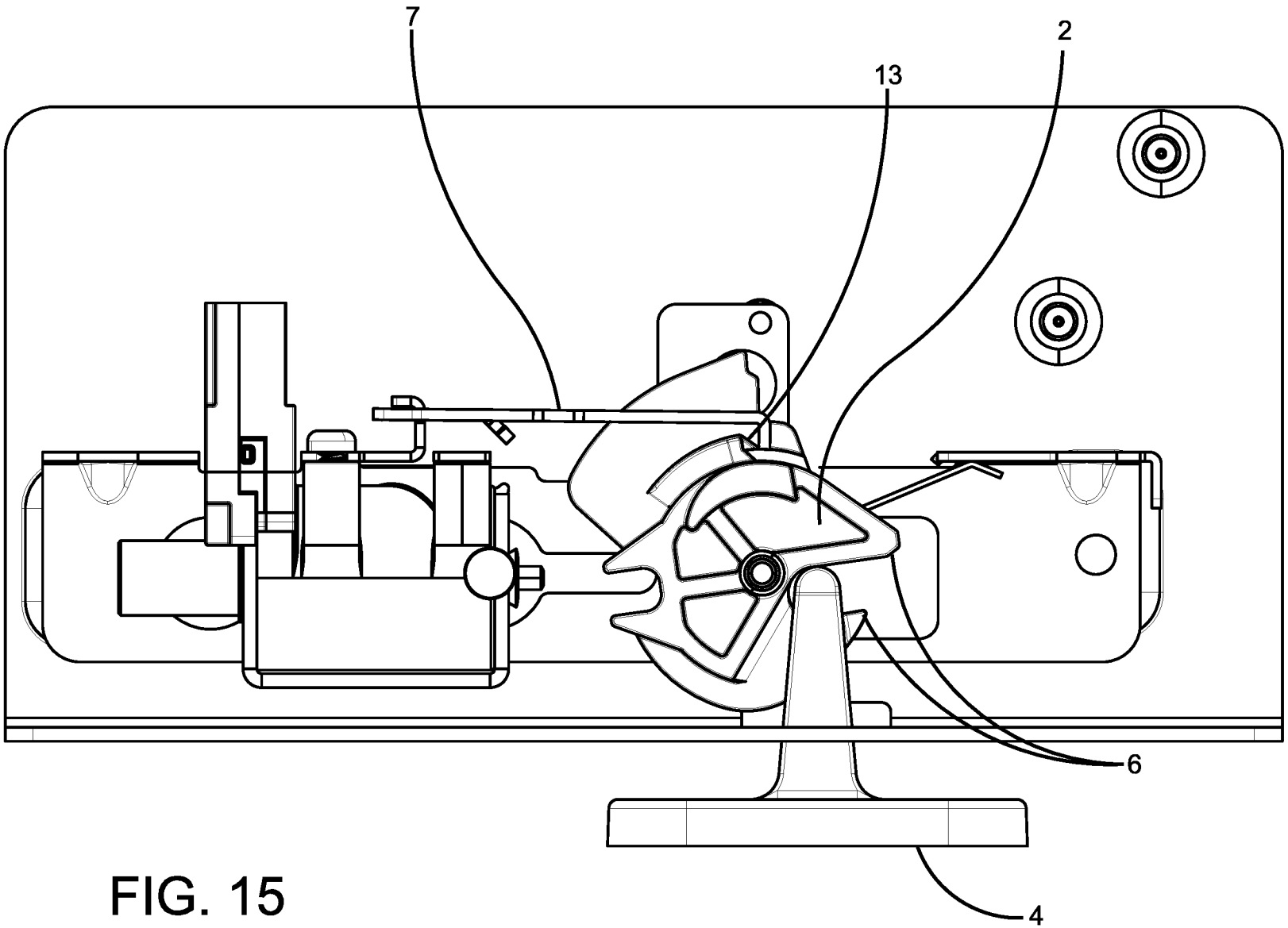
FIG. 15 is a top cut away view of the push-to-open/signal-to-open latching system and integrated locking device in a closed configuration.
Figure 16:
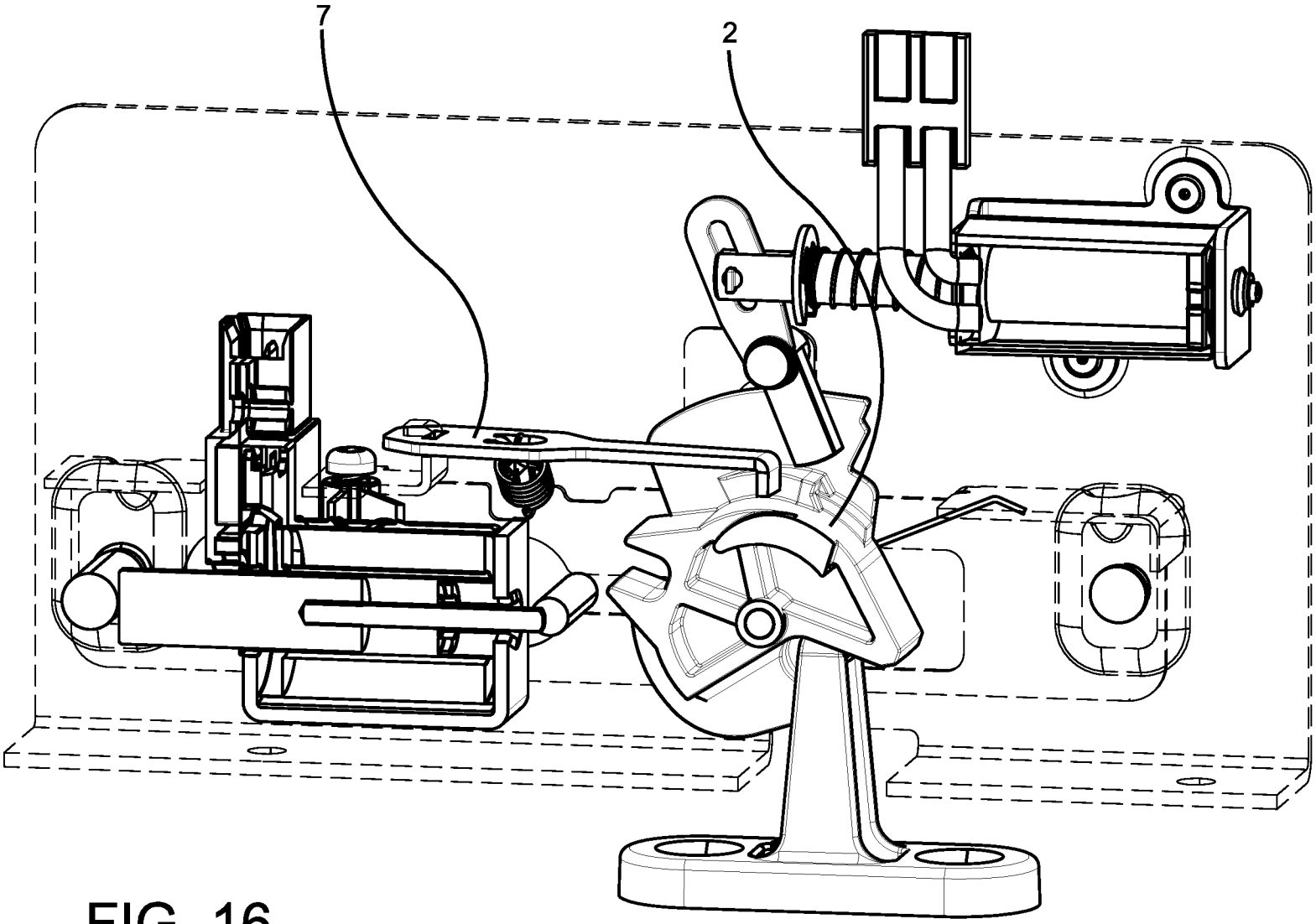
FIG. 16 is a perspective cut away view of the push-to-open/signal-to-open latching system and integrated locking device in a closed configuration.

Provided is a latching system for a household appliance such as an oven that is used for cooking. According to certain aspects of the present disclosure, the latching system includes a push-to-open oven appliance latch that includes an integrated locking device. The locking device functions as a safety feature, preventing a user from opening the oven door during operation of the oven's self-clean cycle and for a period time after completion of the self-cleaning cycle to allow the oven to cool.

Referring to FIGS. 1-20, the latch system and integrated locking device includes a push-to-open latch (1) with a rotating cam (2) that is rotationally biased with a torsion spring (3) and mechanically rotated by a pawl (4) affixed to the oven door (5). To engage the locking device, the oven door (5) is first pushed to a closed position so that a pawl (4) positioned on the inside surface of the oven door (5) engages the push-to-open latch (1). More specifically, as the oven door (5) is closed, the pawl (4) engages a latching slot (6) within a rotating cam (2) within the push-to-open latch (1). This engagement between the pawl (4) and the latching slot (6) forces the cam (2) to rotate. As the rotating cam (2) rotates, it engages a latching finger (7) positioned behind the rotating cam. The latching finger (7) is connected to a biasing spring (8) and has a first end pivotally affixed (9) to a carriage frame (10) which houses various components of the push-to-open latch system and integrated locking device and a second free end (76). As one end of the latching finger (7) is engaged by the cam, a guiding ramp (11) integral with the outside surface rotating cam (2) engages the second free end (76) of the latching finger (7). The latching finger continues its contact with the guiding ramp (11) and is guided along the guiding ramp (11) as the cam (2) rotates until the guiding ramp (11) comes into contact with a catch surface (12), a component which is also integral with the outside surface of the rotating cam (2). In this position, the latching finger (7) is mechanically engaged with the rotating cam (2). This prevents the rotating cam (2) from releasing the pawl (4), thus holding the oven door (5) in a closed or latched position for cooking and self-cleaning operations.

To release the pawl (4) and unlatch the oven door (5), the user must push the oven door (5) inwards near the push-to-open latch (1). This motion induces a small amount of counter-rotation of the rotating cam (2) in a direction that is opposite or away from oven door (5) opening. The counter-rotation of the rotating cam (2) guides the latching finger (7) to a secondary ramp (13) that is integrated on the exterior surface of the rotating cam (2). As the cam (2) continues to counter-rotate, the secondary ramp (13) causes the latching finger (7) to lift up from the catch surface. Thus, the upward motion caused by the secondary ramp's (13) contact with the latching finger (7) results in the latching finger (7) being released from the catch surface (12). Once the latching finger (7) is released from the catch surface (12) and travels back down the guiding ramp (11), the pawl (4) is released from the rotating cam's latching slot (6) and the oven door is free to move outward.

Figure 34:
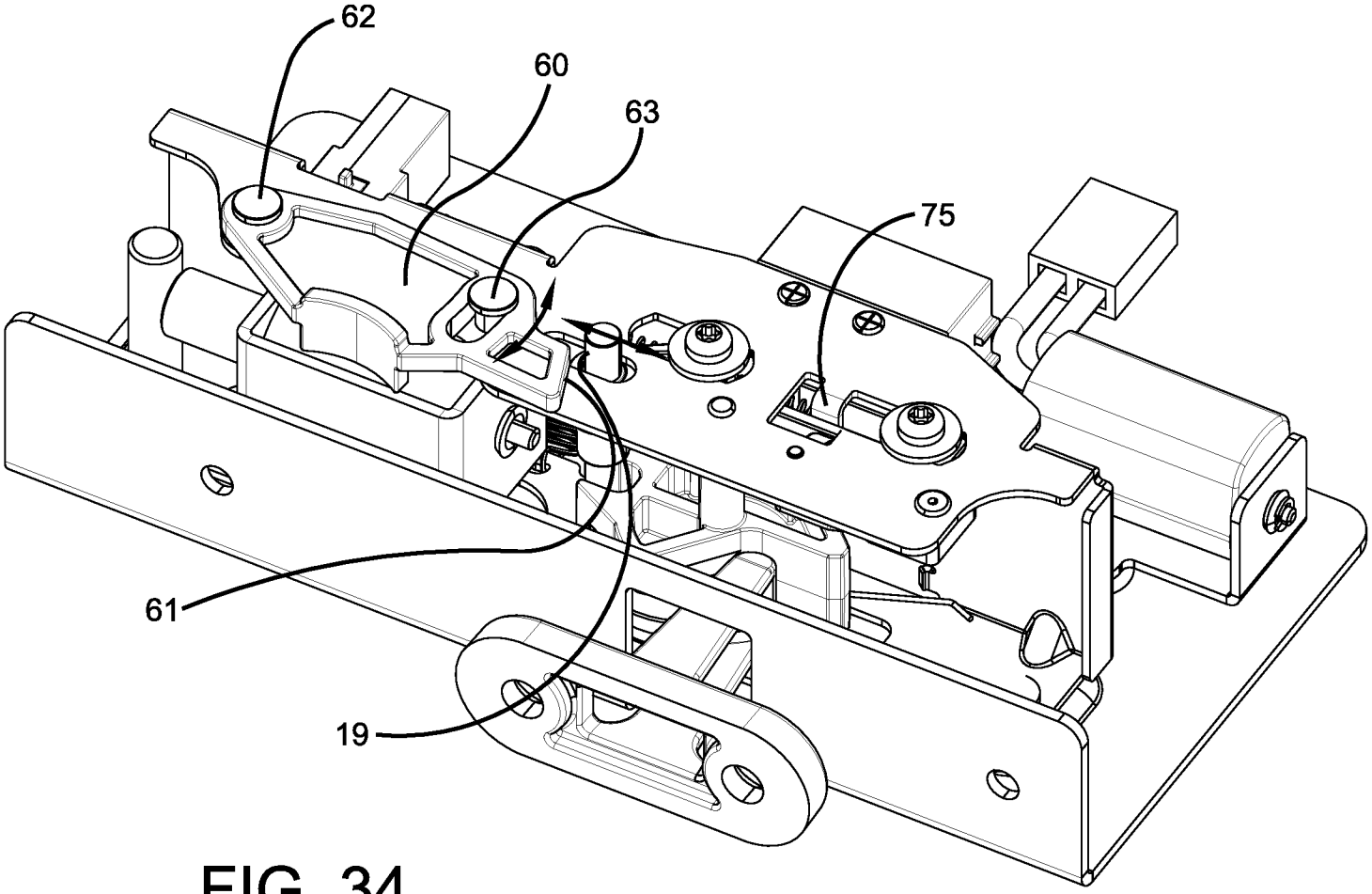
FIGS. 34-38 are perspective views of a manual override system within the push-to-open/signal-to-open latching system.
Figure 35:
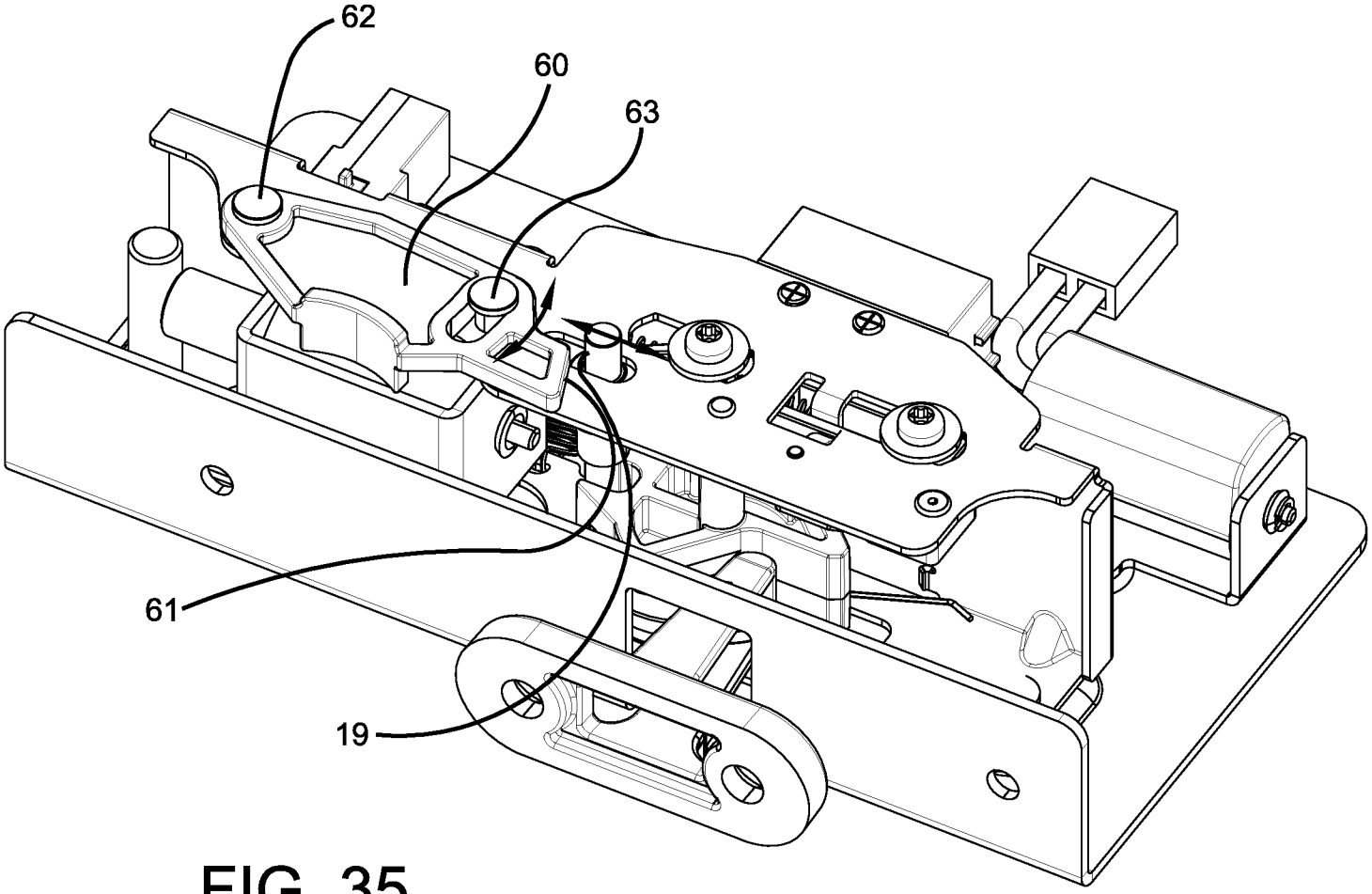
Figure 36:
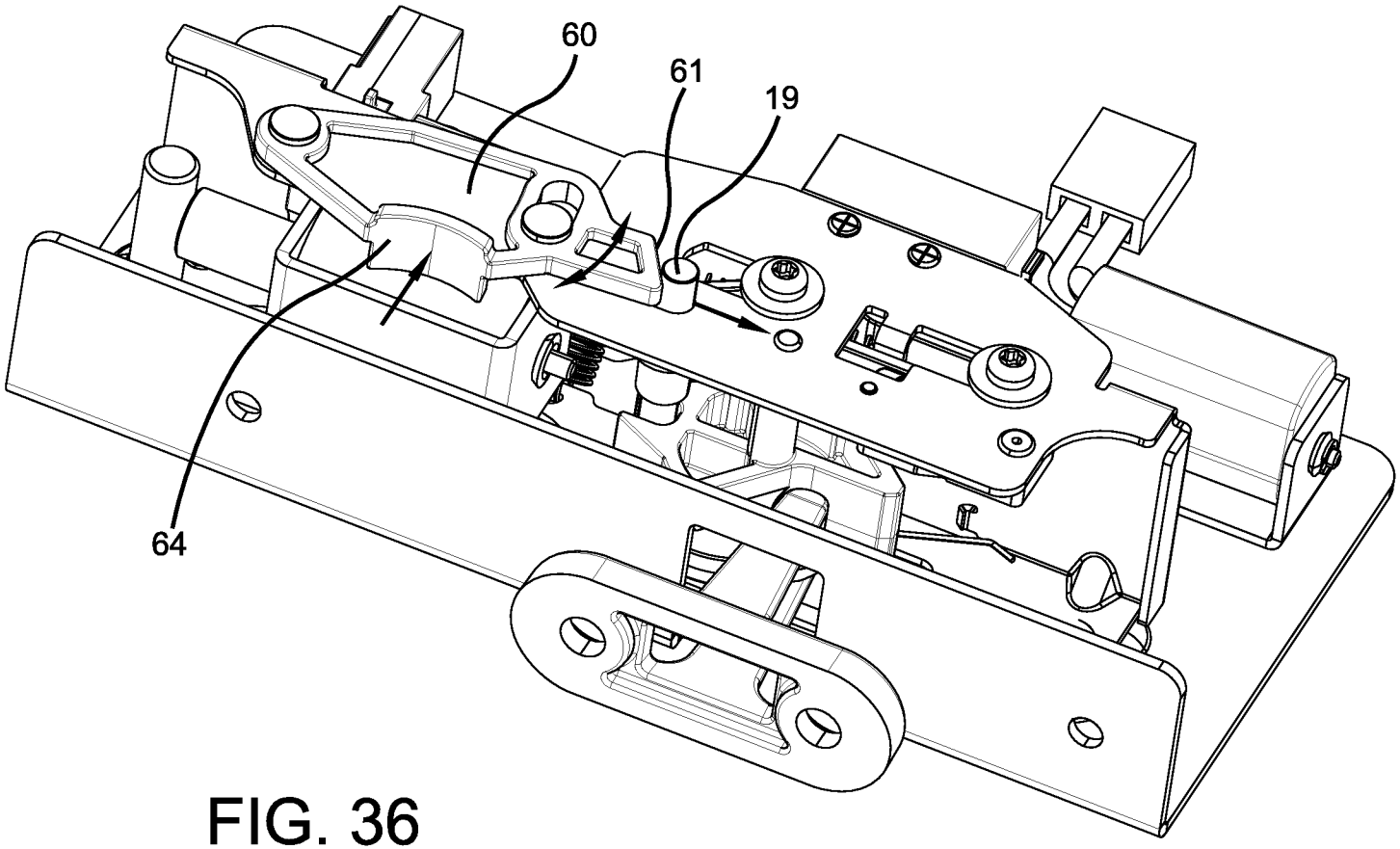
Figure 37:
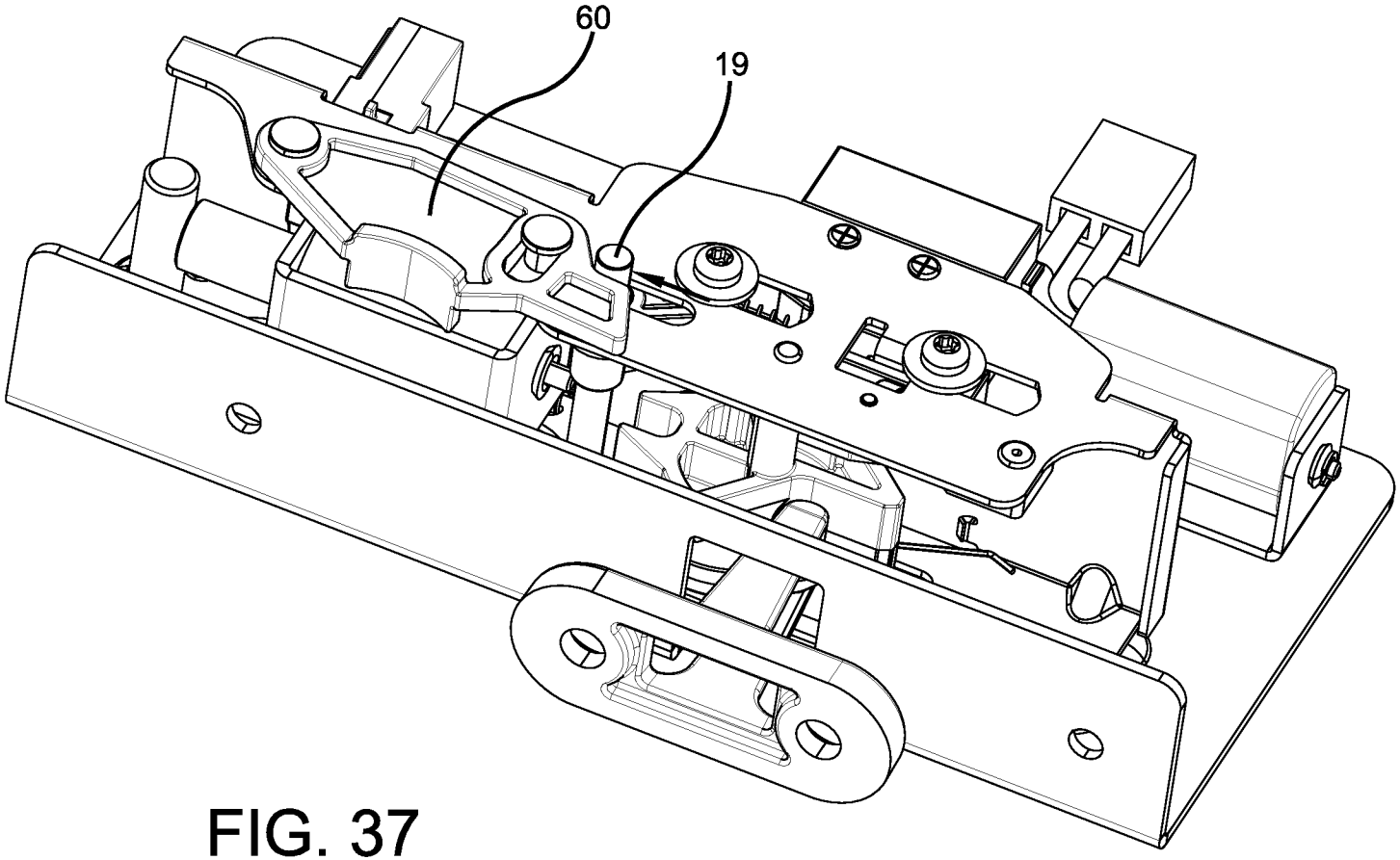
Figure 38:
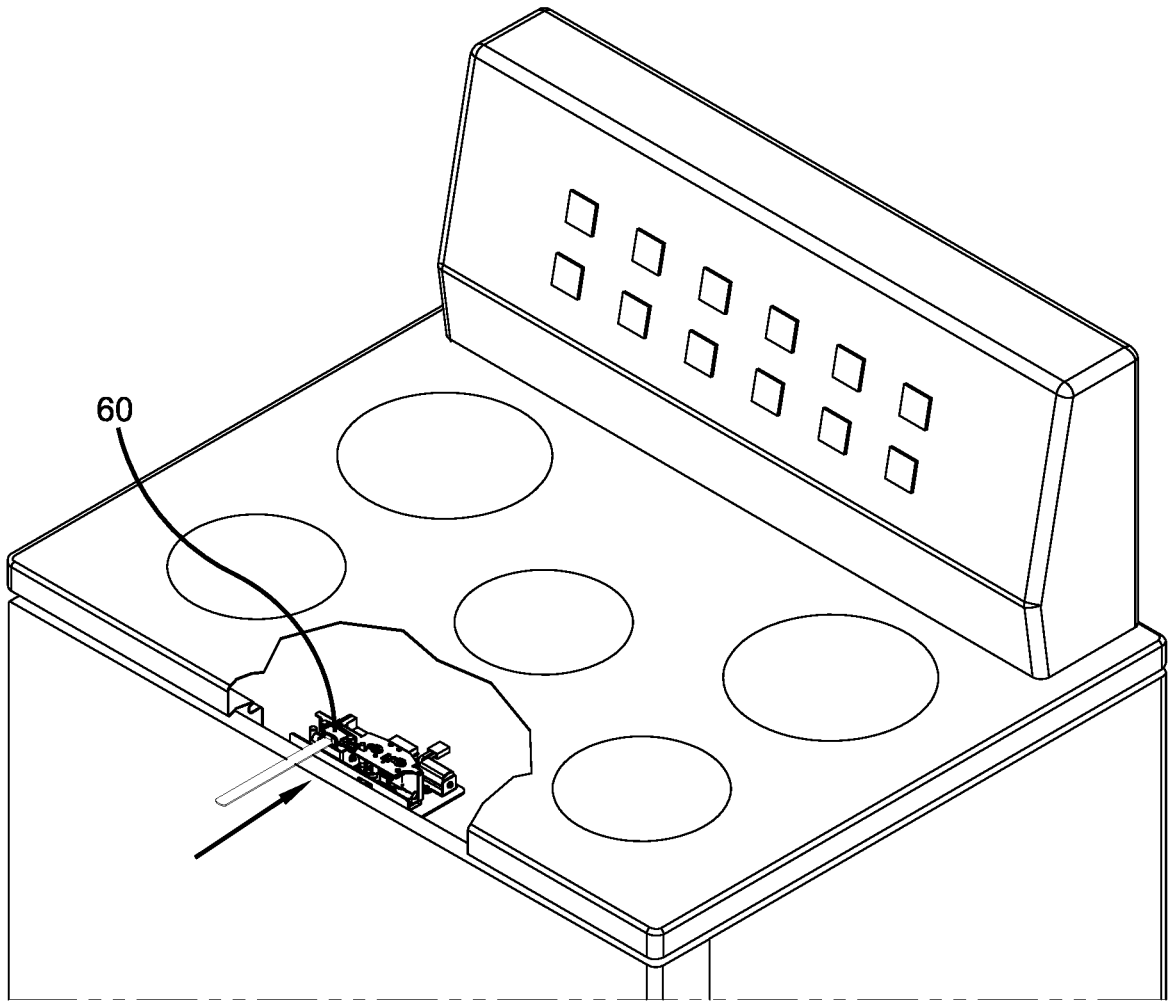

According to certain aspects of the present teaching, the push-to-open latch (1) also incorporates a locking slide (16) and locking slide pin (19) connected to the bottom side of the locking slide (16). Both the locking slide (16) and the locking slide pin (19) are actuated by a linear solenoid (17). These features are primarily shown within FIGS. 4, 8, 17 through 19 and 21. The locking slide (16) is designed to travel in slots (18) of the carriage frame (10) and is biased with a slide biasing spring (21) in a retracted position within the carriage frame (10). When a locking mechanism or self-cleaning function is selected on the oven's controller (20), the linear solenoid (17) is activated to momentarily induce a force upon the locking slide (16) in the direction opposite the locking slide's biasing spring (21). This results in the locking slide (16) and the locking slide pin (19) moving in a lateral direction to engage a locking slot (22) on the rotating cam (2). This feature locks and secures the oven door. When the linear solenoid (17) is deactivated, the slide biasing spring (21) pushes off of a flange (75), which is attached to the carriage frame (10), shown in FIG. 34. The flange (75) provides the surface necessary for the slide biasing spring (21) to push off of and thus provide the force required for a pivoting toggle (23) to traverse crescent niches (40) and (41) of the locking slide (16). This force and motion described here locks and unlocks the rotating cam (2) with the locking slide pin (19) as a result of an operator performing the push-to-open motion on the over door (5). This aspect of the latching system is discussed in more detail in the next paragraph.

Figure 17:
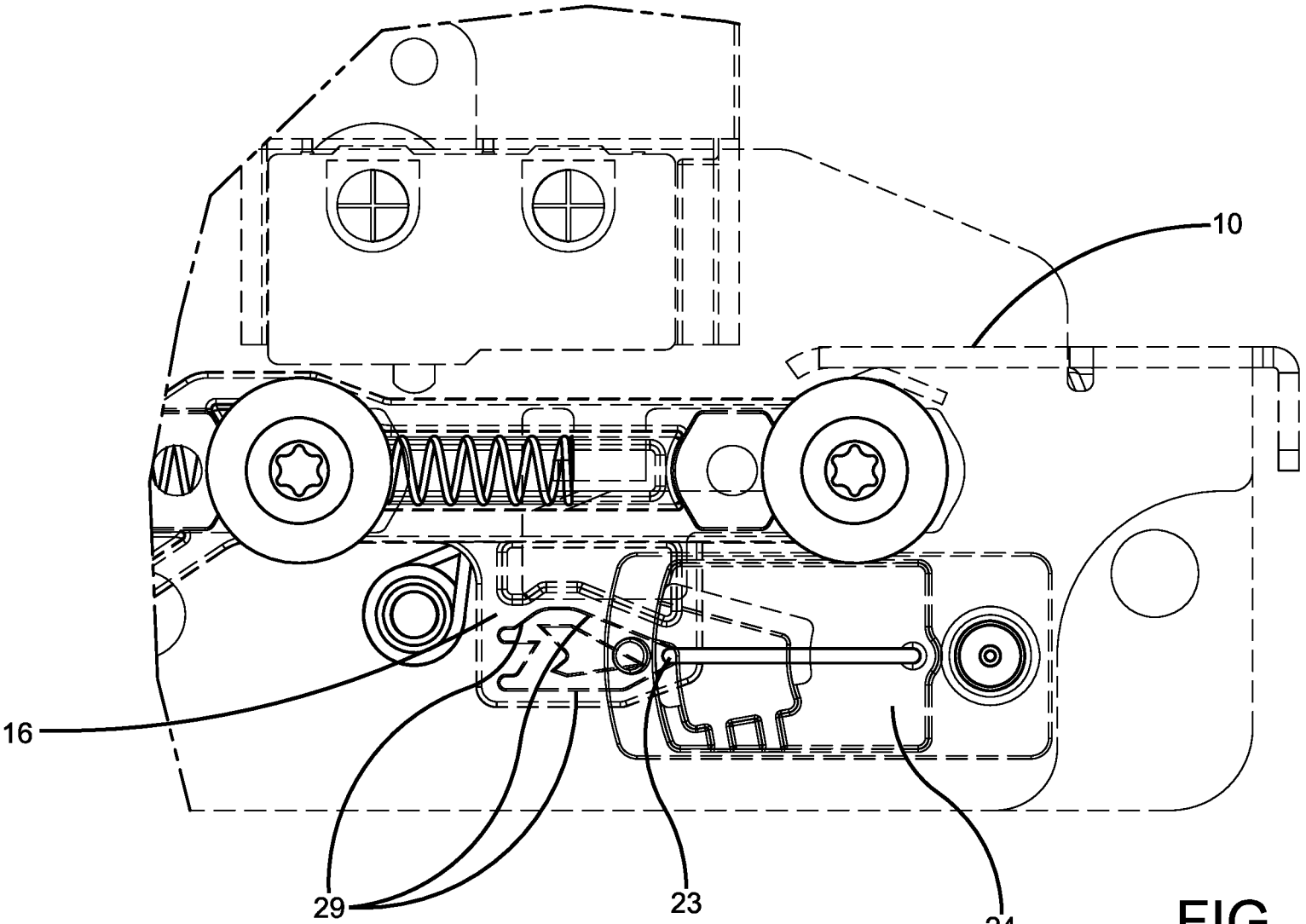
FIG. 17 is a top view of the push-to-open/signal-to-open latching system and integrated locking device in a closed configuration.
Figure 18:
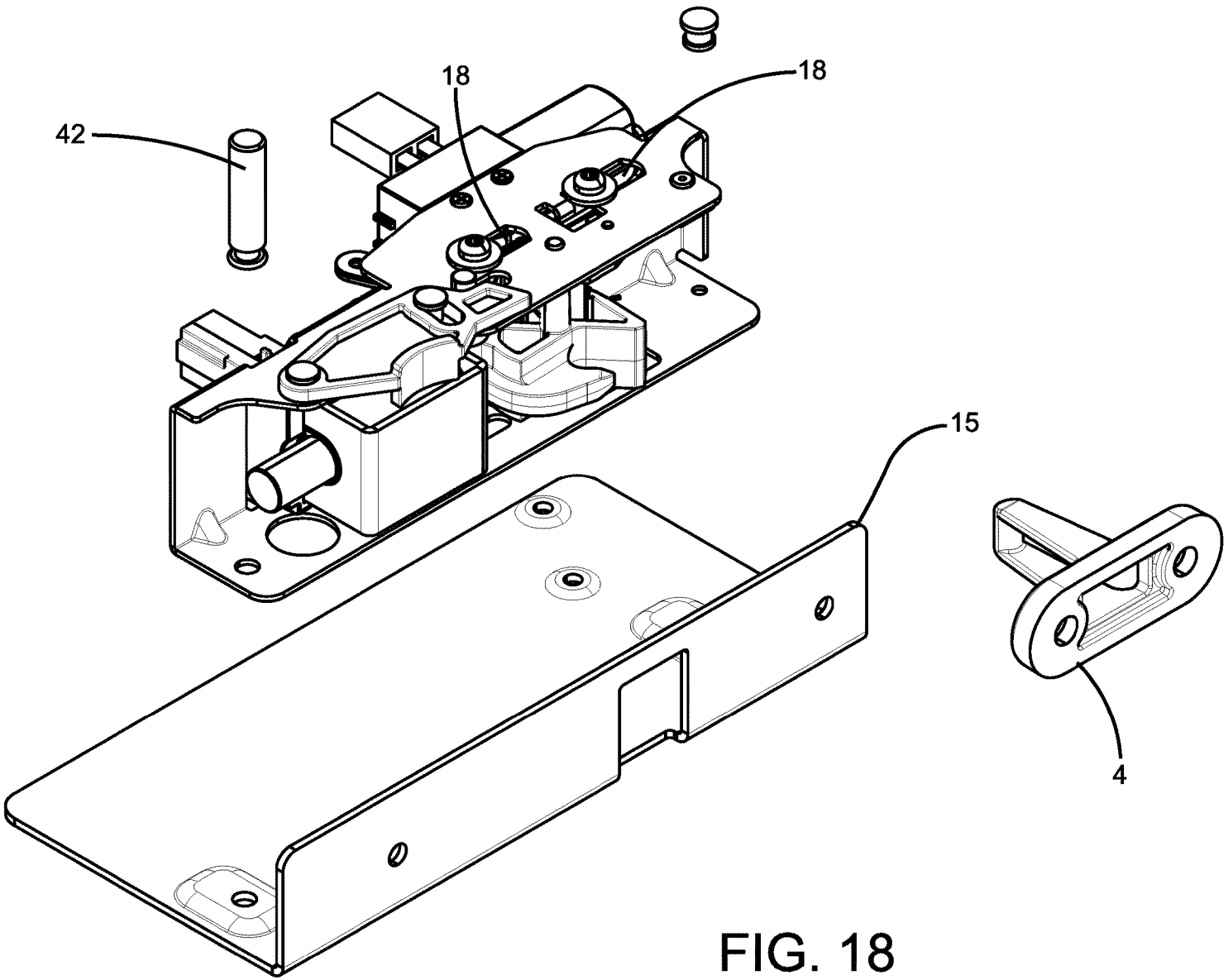
FIG. 18 is an exploded perspective view of the push-to-open/signal-to-open latching system and integrated locking device.
Figure 19:
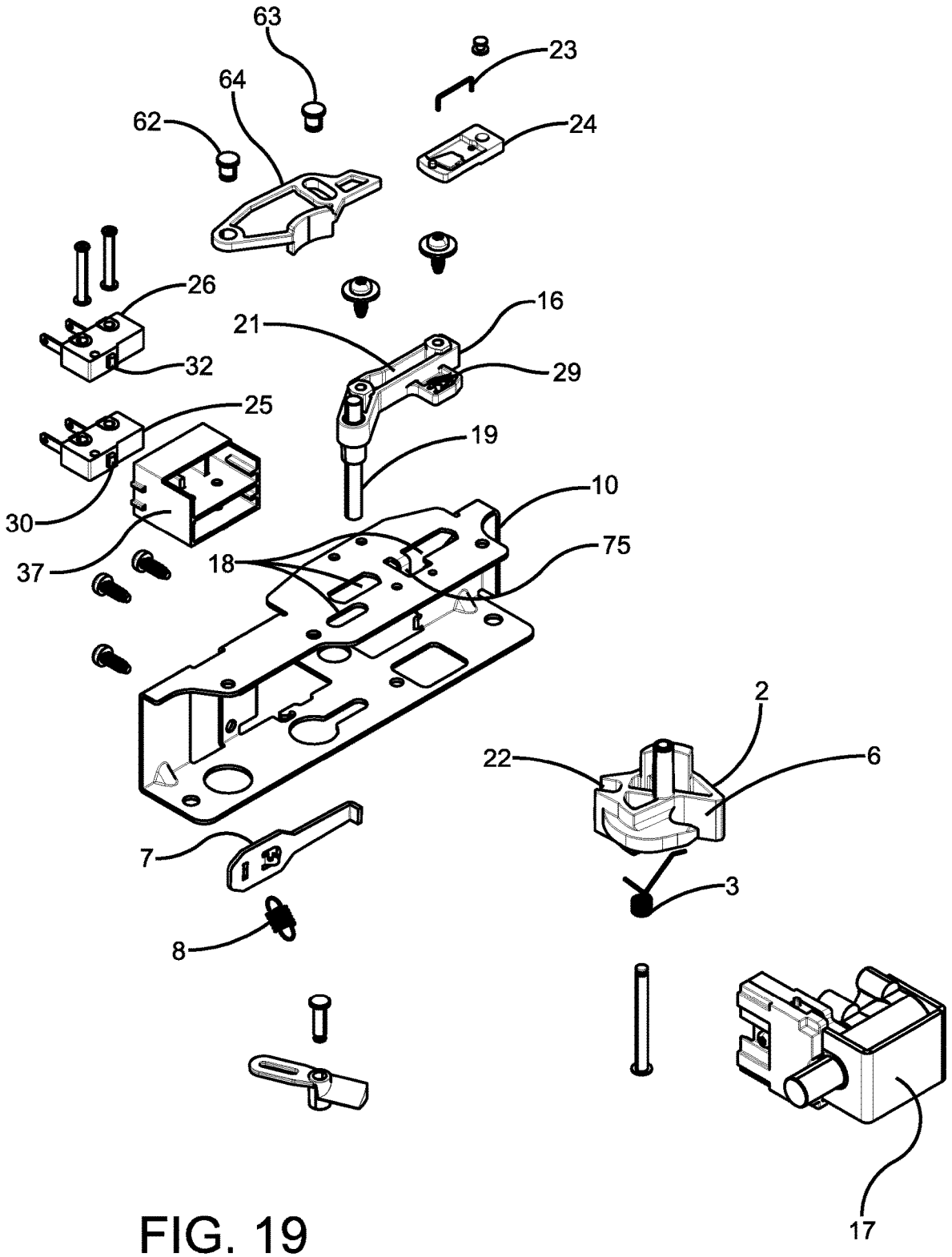
FIG. 19 is an exploded perspective view of the push-to-open/signal-to-open latching system and integrated locking device.
Figure 20:
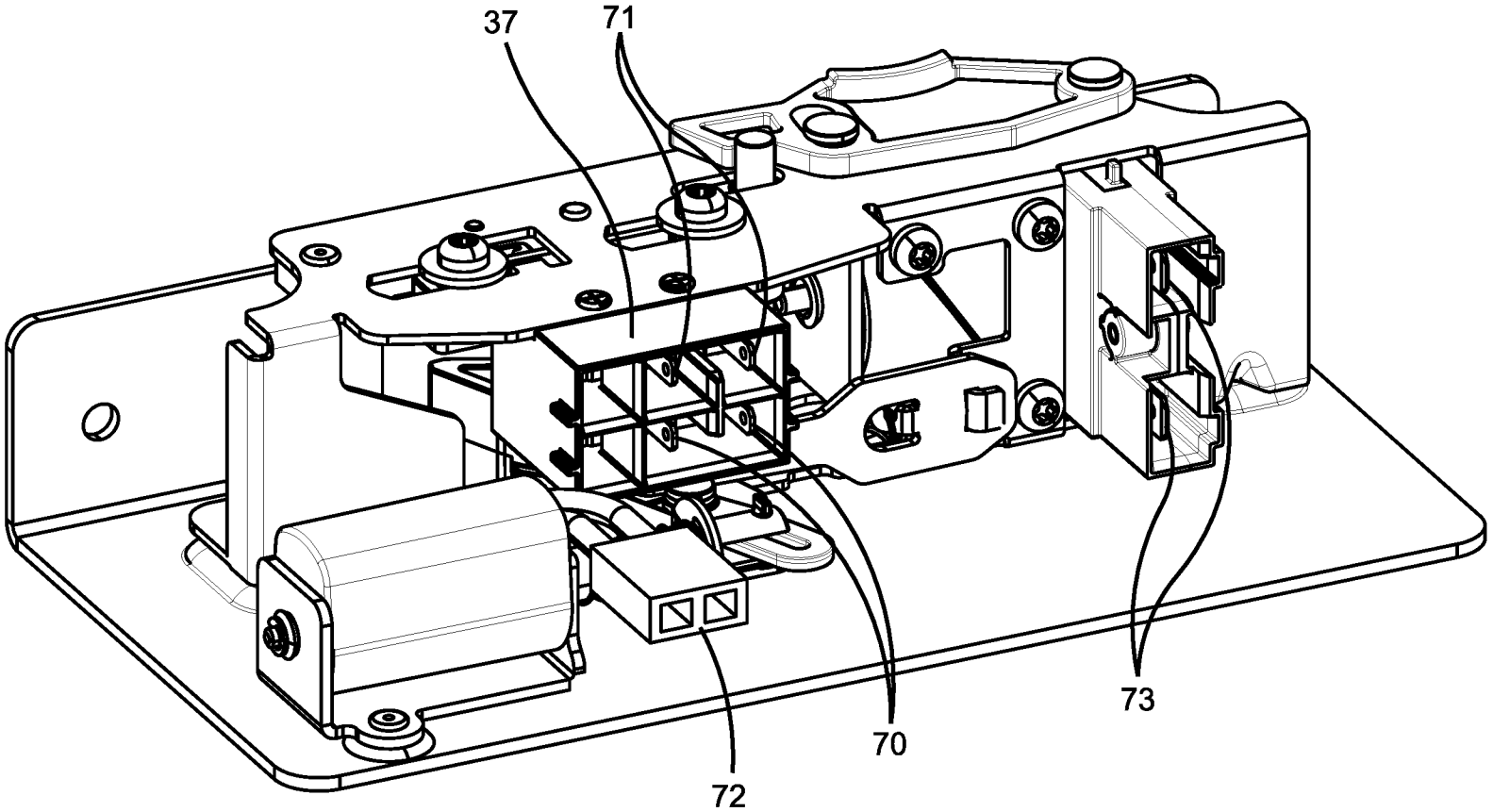
FIG. 20 is a perspective assembled view of the push-to-open/signal-to-open latching system and integrated locking device.
Figure 21:
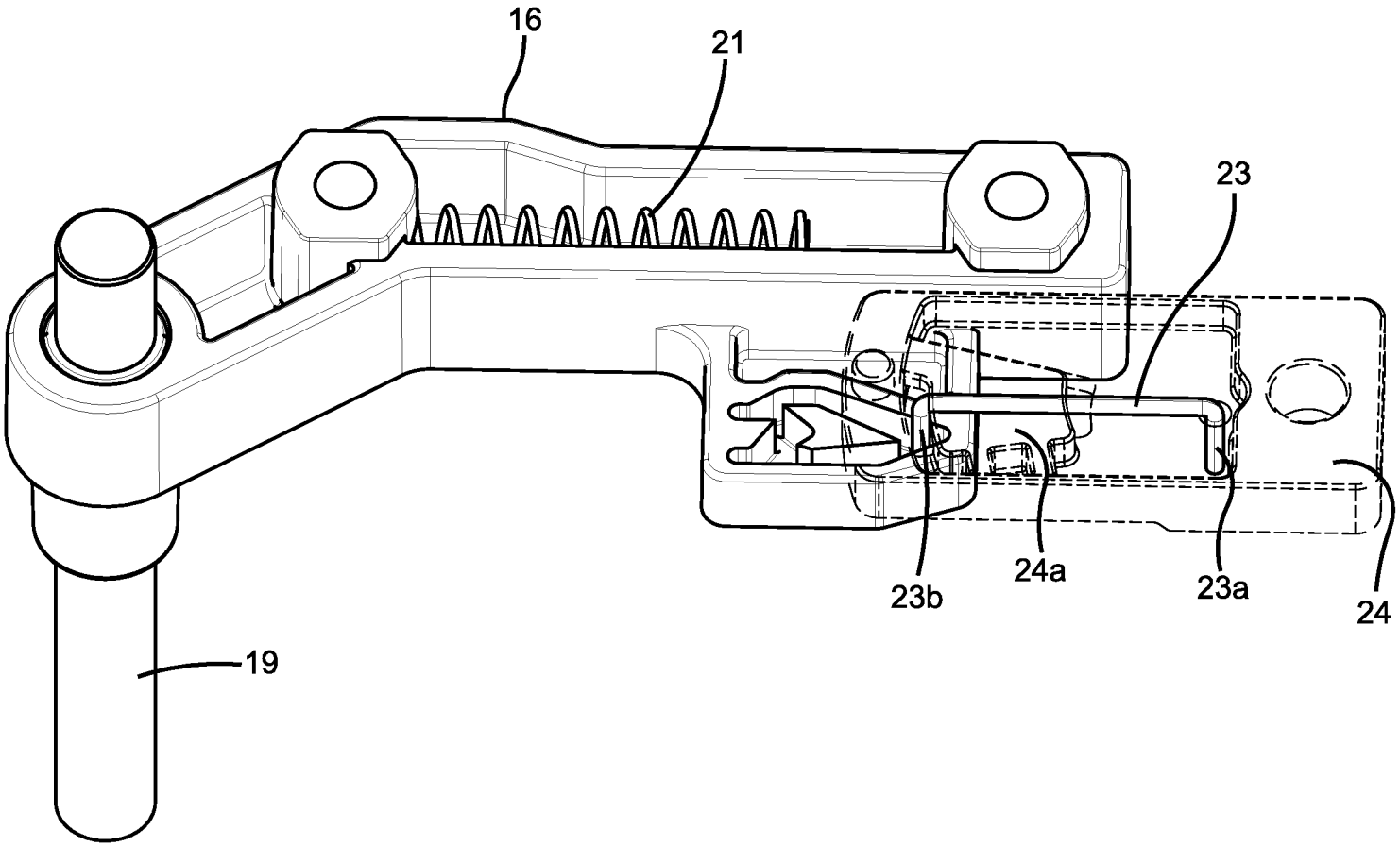
FIG. 21 is a perspective view of a locking slide and pivoting toggle of the push-to-open/signal-to-open latching system and integrated locking device.
Figure 22:
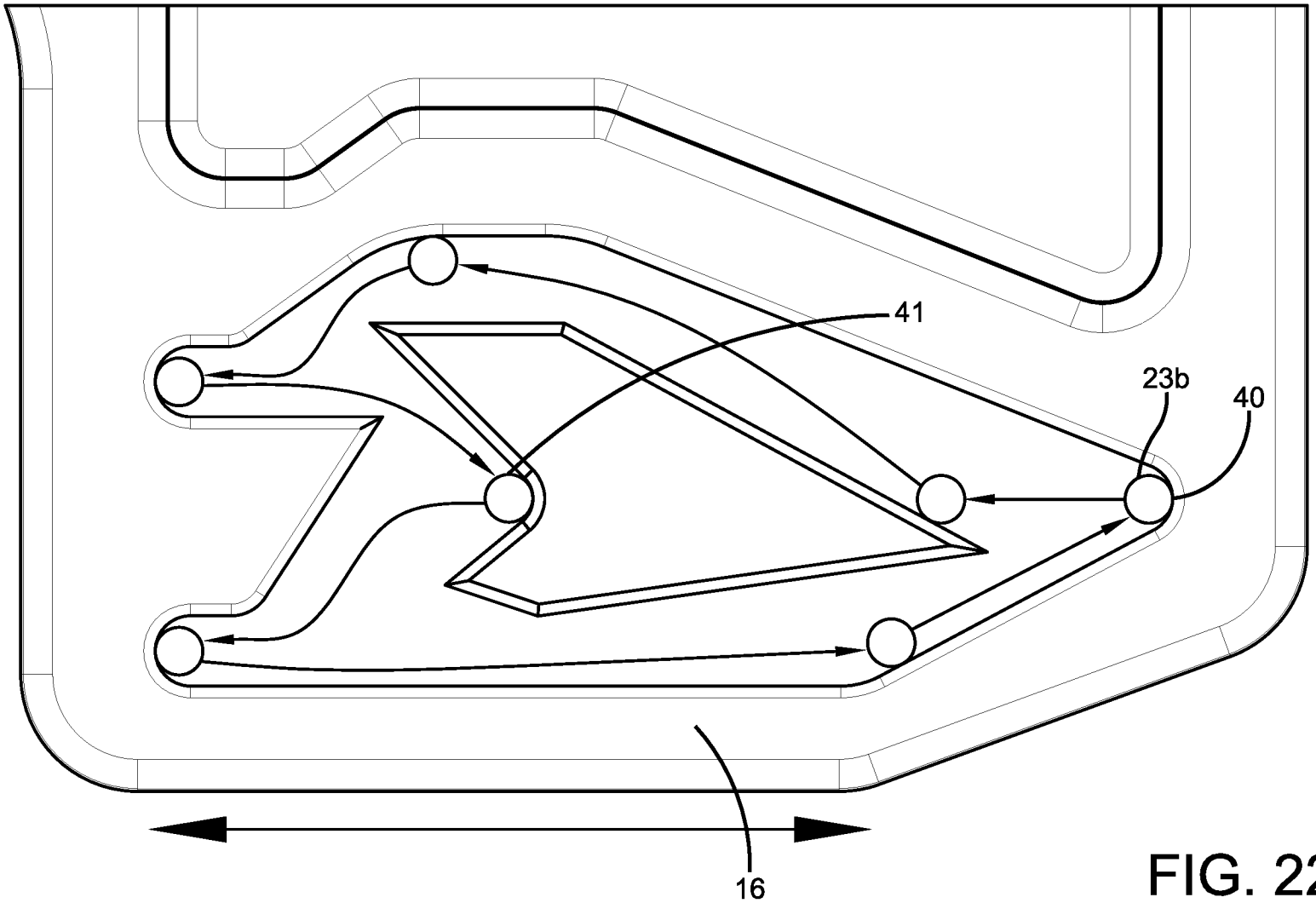
FIG. 22 is a planar top view of the pathway of travel of the pivoting toggle of the push-to-open latching/signal-to-open system and integrated locking device.
Figure 23:
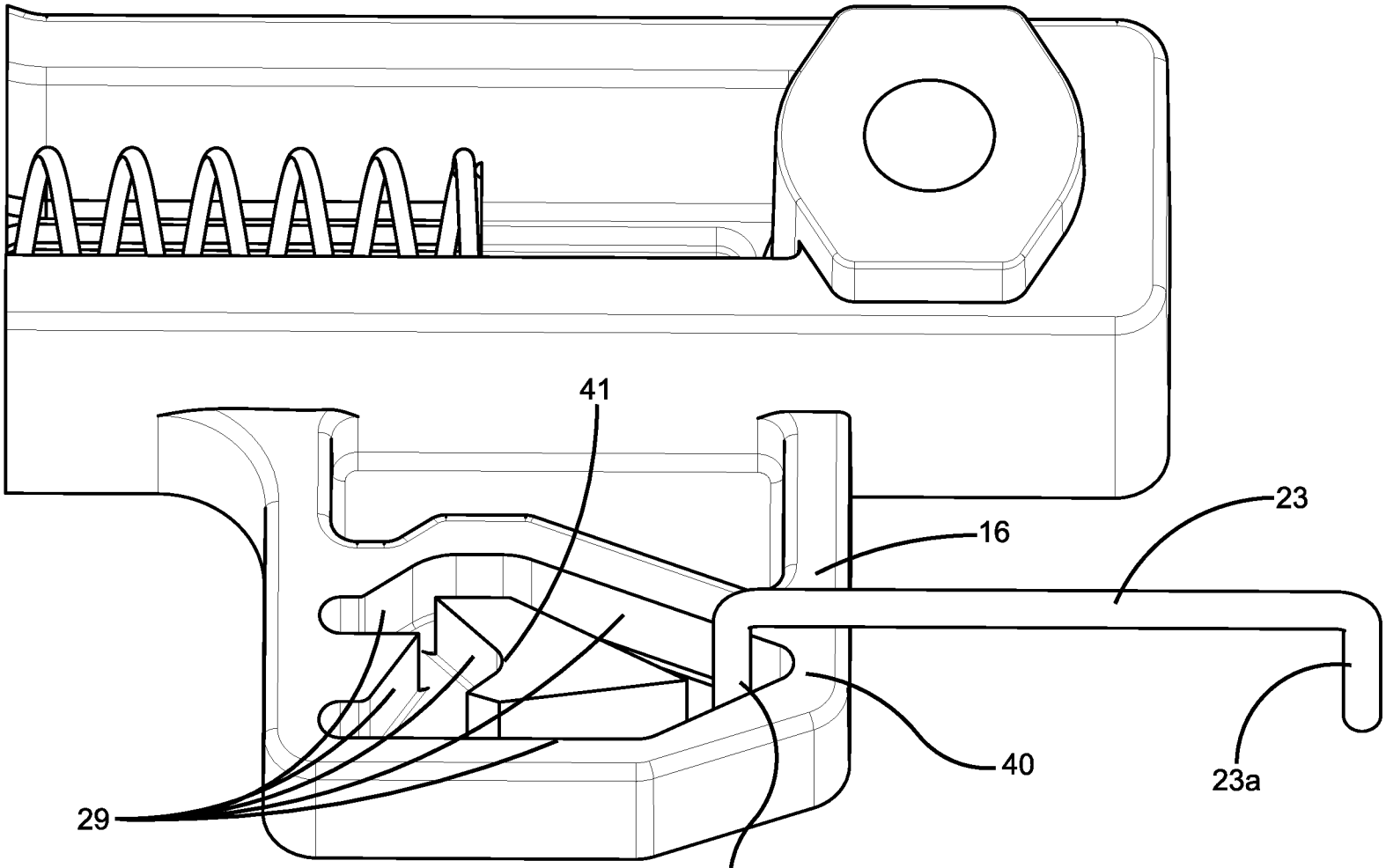
FIG. 23 is a perspective zoomed-in view of component parts of the locking slide and pivoting toggle of the push-to-open/signal-to-open latching system and integrated locking device as shown in FIG. 21 in the locked-off position.
Figure 24:
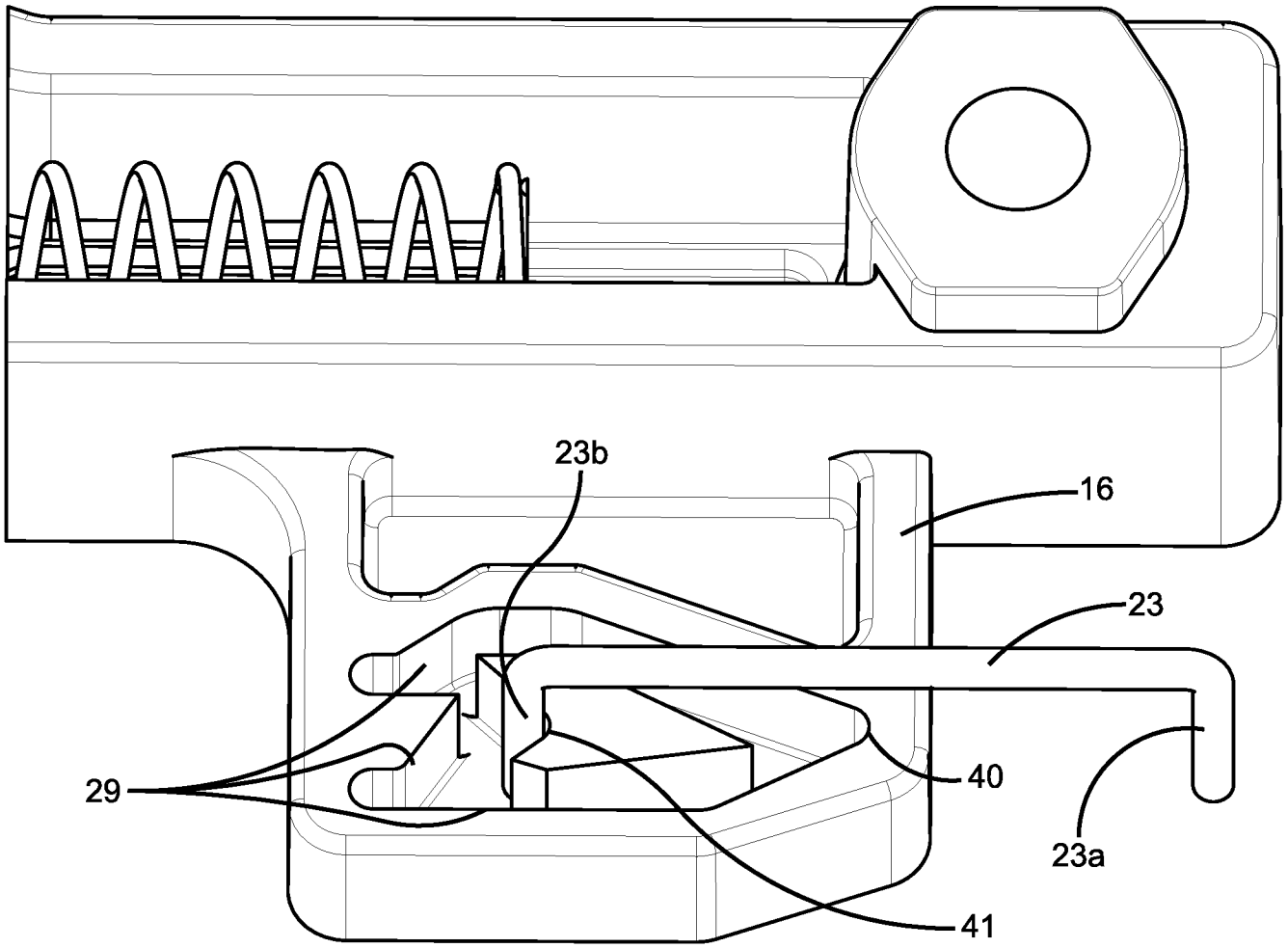
FIG. 24 is a perspective zoomed-in view of component parts of the locking slide and pivoting toggle of the push-to-open/signal-to-open latching system and integrated locking device as shown in FIG. 21 in the locked-on position.

According to further aspects of the present teaching, the locking slide (16) may include a pivoting toggle (23) as shown within FIG. 17. The pivoting toggle (23) may alternately toggle between a lock-on (41) and a lock-off (40) position with each linear movement of the locking slide (16). The pivoting toggle (23) is supported by a pivot support (24) which is rigidly attached to the carriage frame (10). The alternating pivoting toggle (23) positions are directed by toggle guide surfaces (29) incorporated in the locking slide (16). Operation of the pivoting toggle is illustrated within FIGS. 21 through 24. As shown within FIGS. 21 through 24, the pivoting toggle (23) includes a pivoting leg (23*a*) engaged to the pivoting support (24) and a locking leg (23*b*) which engages toggle guide surfaces (29) within the locking slide (16). The toggle guide surfaces (29) include crescent niches (40) and (41) which provide a location for engagement of the locking leg (23*b*) between lock-on (41) position and the lock-off (40) position. As shown within FIG. 22, the locking leg (23*b*) is directed by the curved toggle guide surfaces (29) to crescent niches (40) or (41), with crescent niche (40) representing the lock-off position and crescent niche (41) representing the lock-on position. Thus, the pivoting toggle (23) provides an additional feature to lock and secure the oven door.

Figure 25:
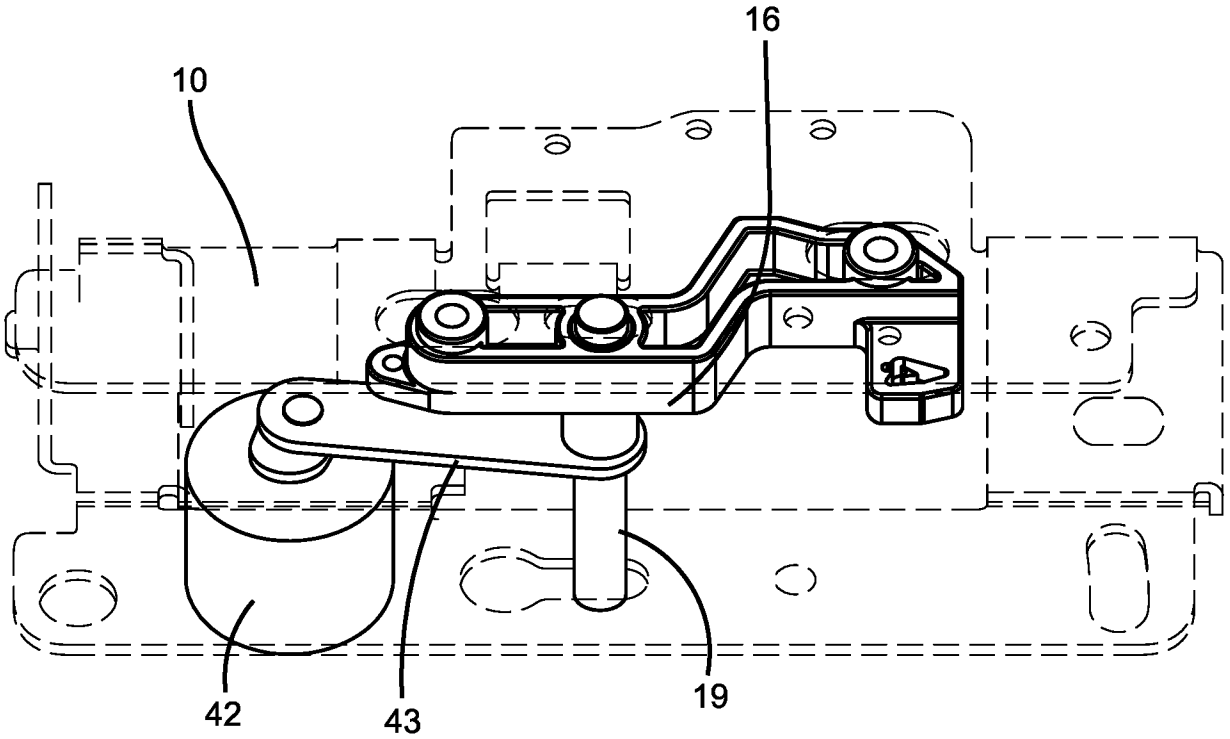
FIG. 25 is a perspective view of a locking slide and locking slide pin of a push-to-open/signal-to-open latching system and integrated locking device activated by a synchronous electric motor.
Figure 26:
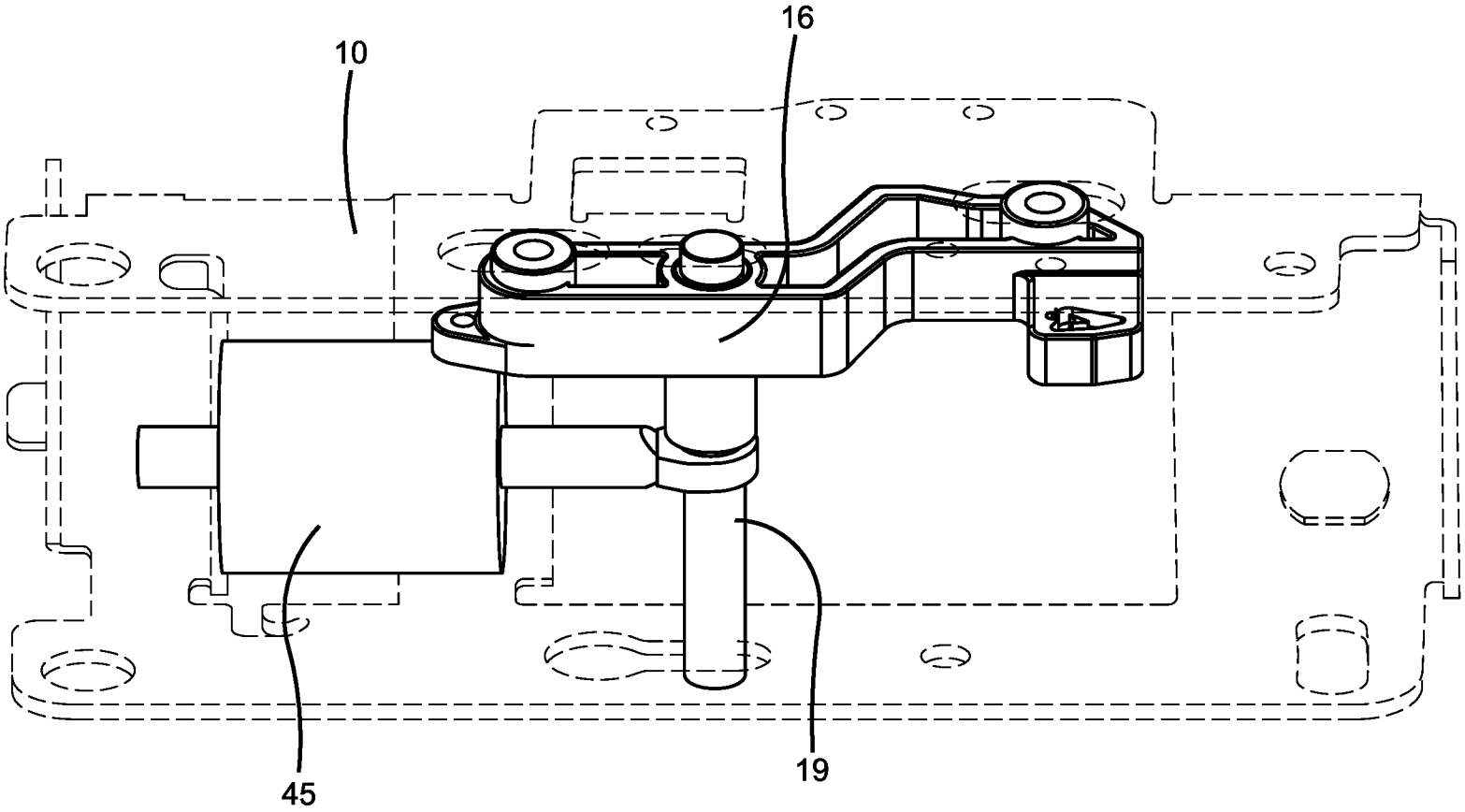
FIG. 26 is a perspective view of a locking slide and locking slide pin of a push-to-open/signal-to-open latching system and integrated locking device activated by a linear leadscrew motor.
Figure 27:
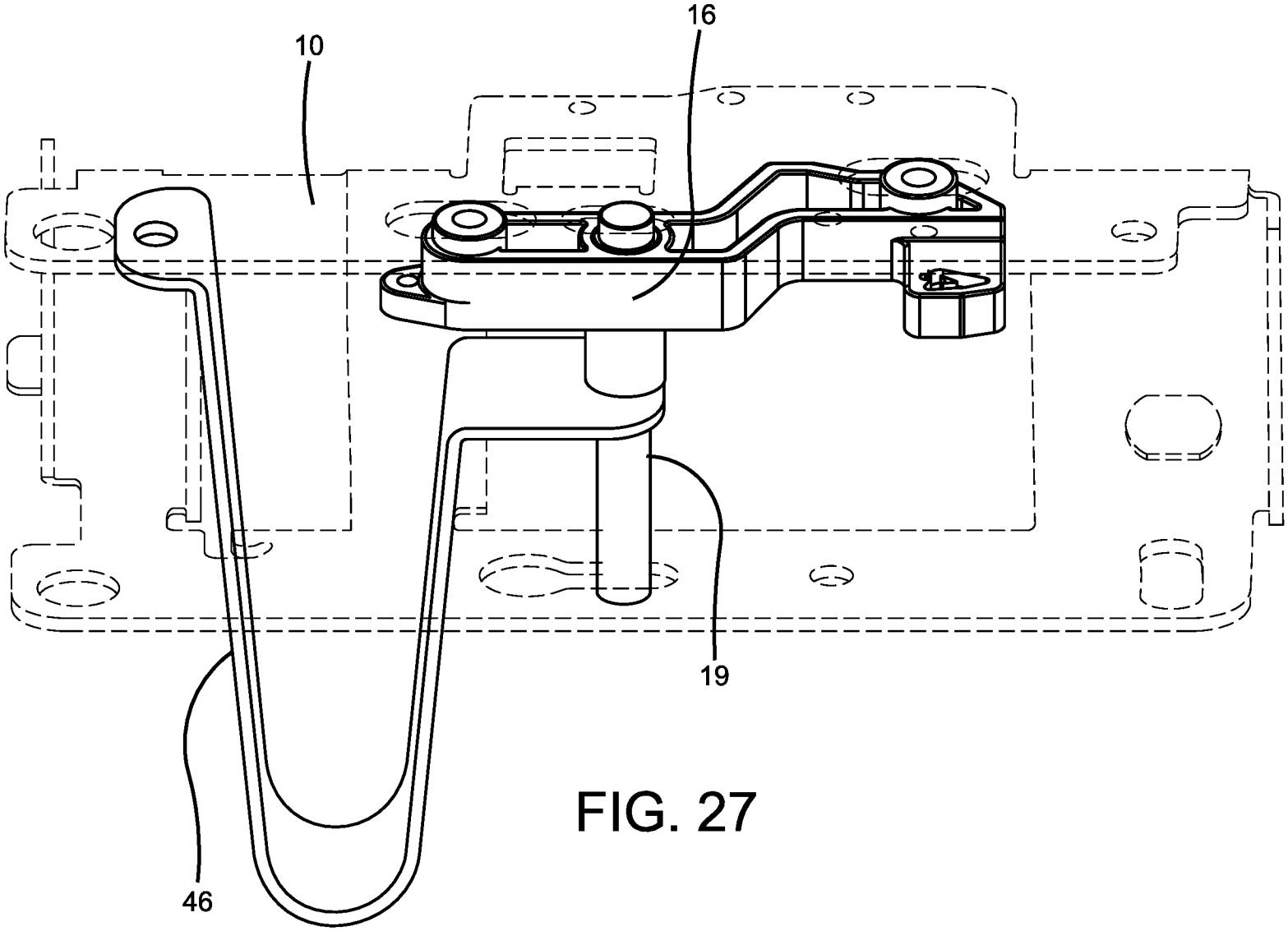
FIG. 27 is a perspective view of a locking slide and locking slide pin of a push-to-open/signal-to-open latching system and integrated locking device activated by a bimetal spring.
Figure 28:
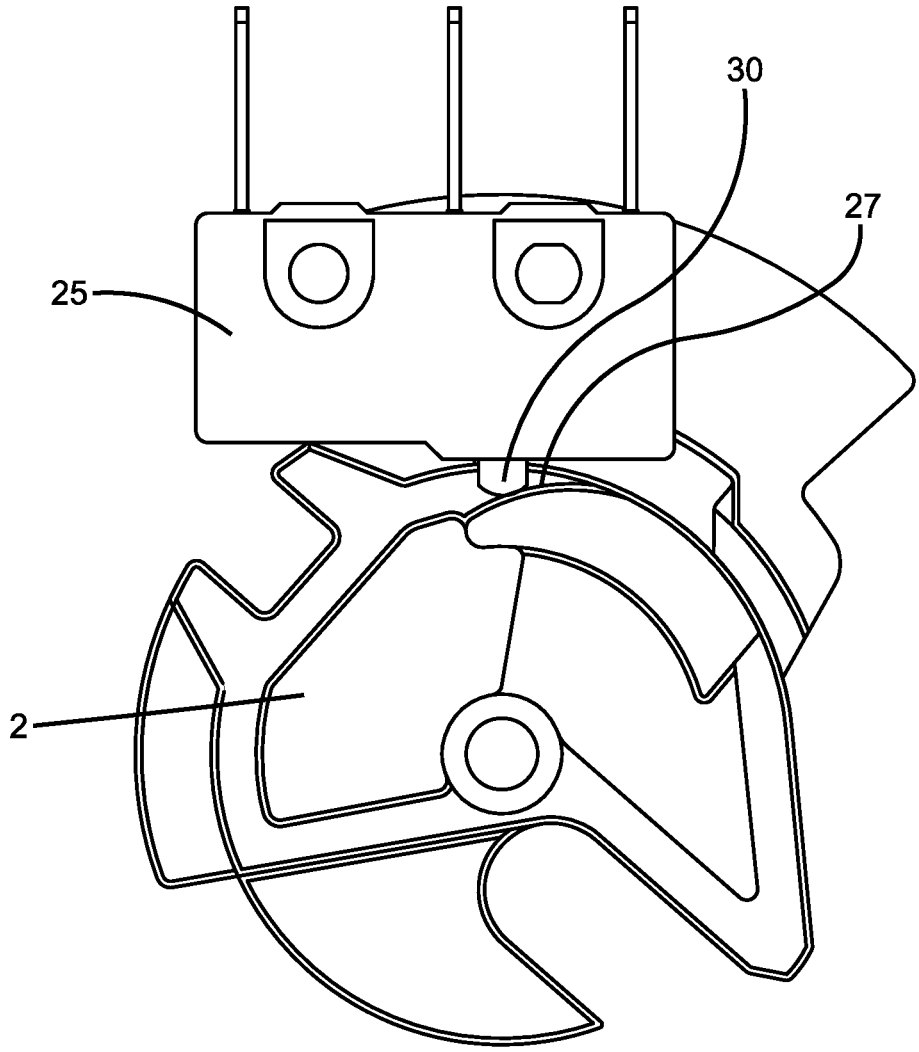
FIGS. 28 and 29 are top planar views of a rotating cam and rotating cam switch of a push-to-open/signal-to-open latching system and integrated locking device.
Figure 29:
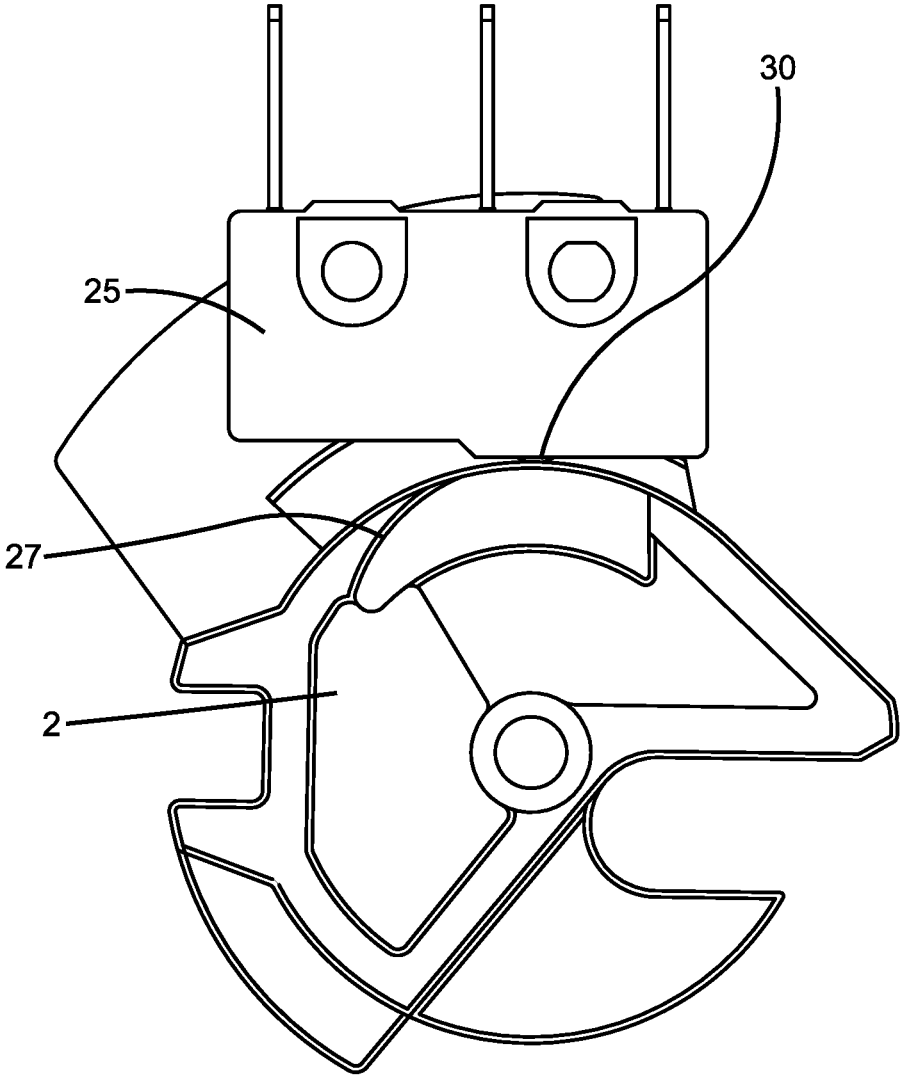
Figure 30:
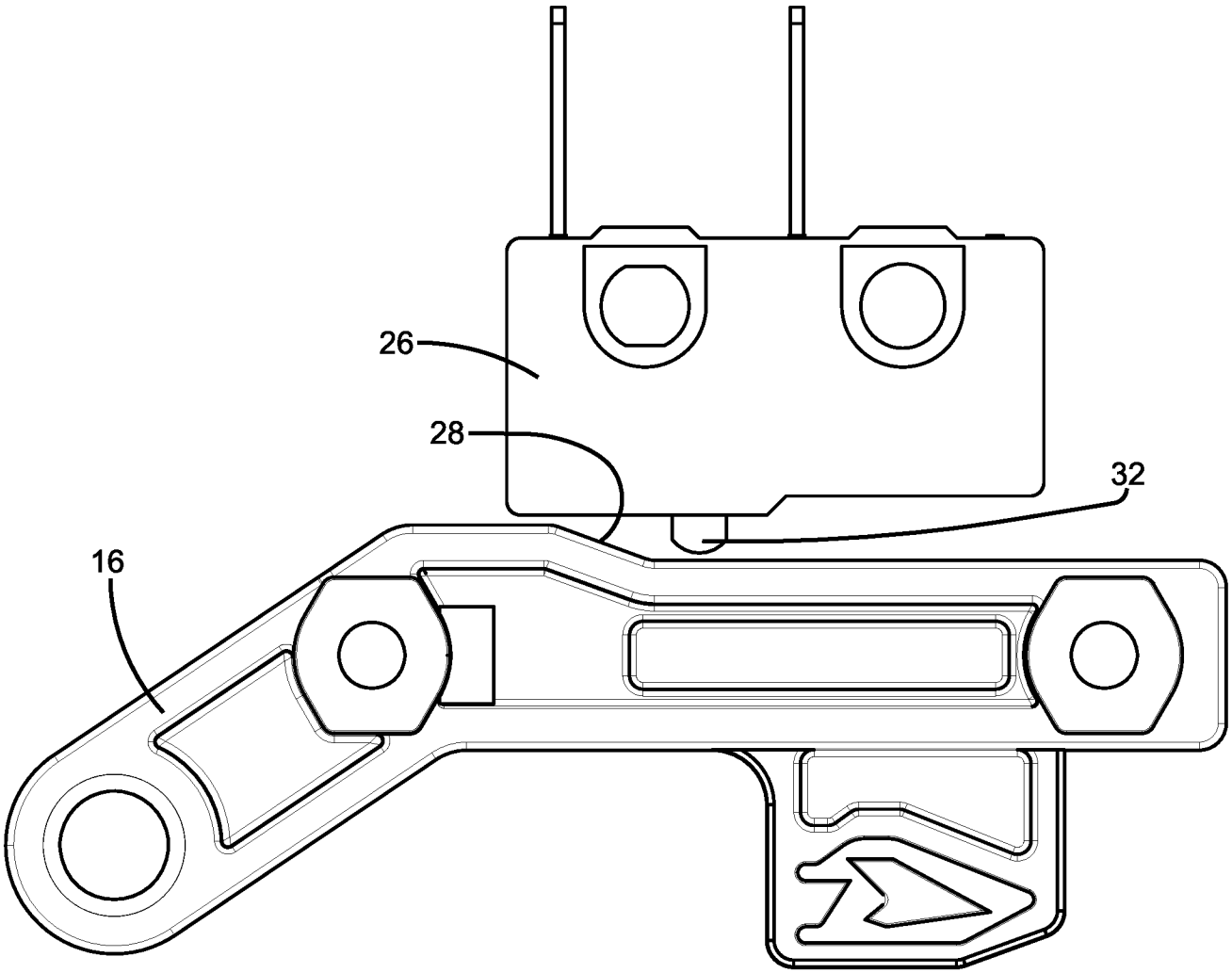
FIGS. 30 and 31 are top planar views of a locking slide and locking slide switch of a push-to-open/signal-to-open latching system and integrated locking device.
Figure 31:
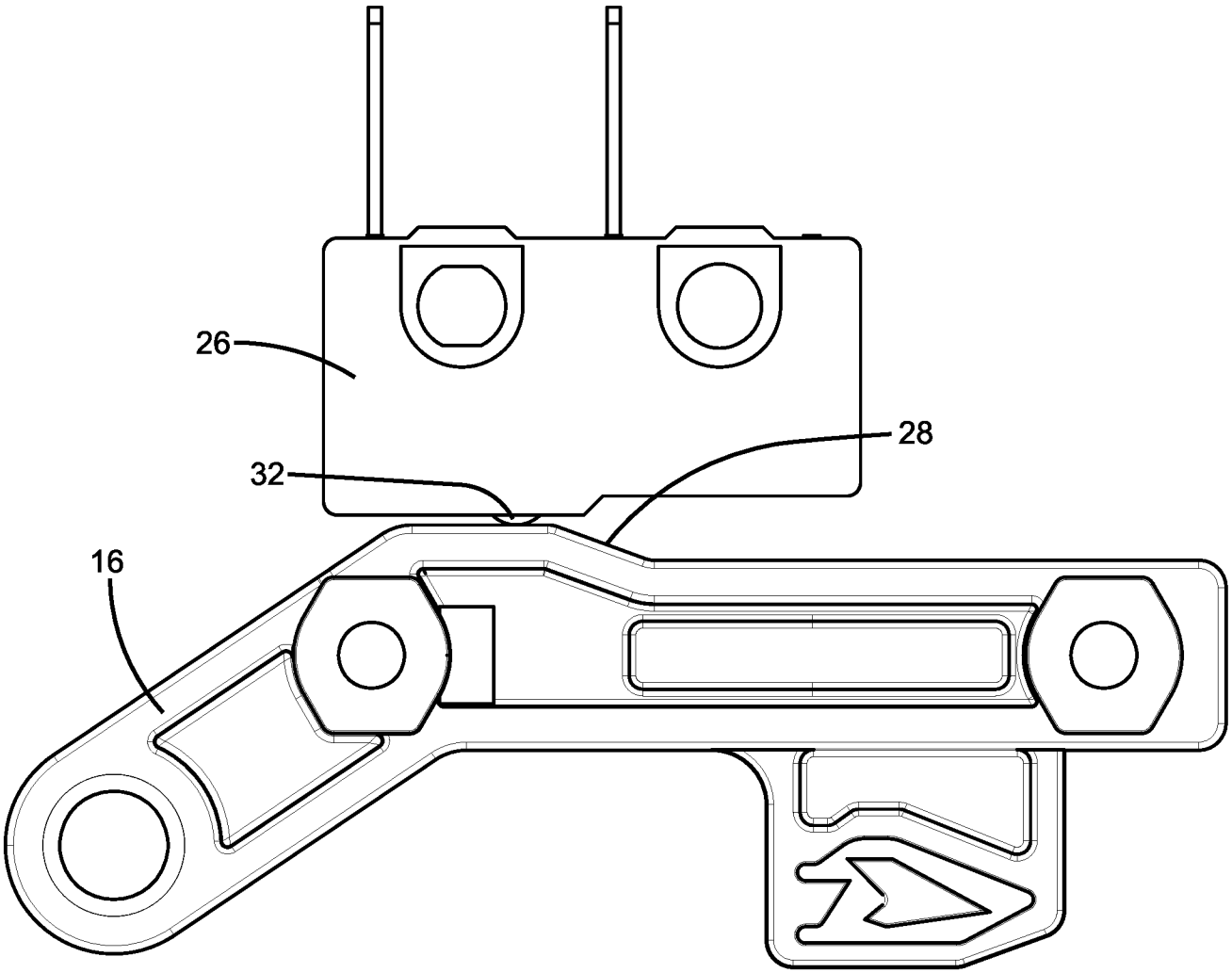

As an alternative to the use of a linear solenoid (17), the locking slide (16) and locking slide pin (19) may be activated by a synchronous electric motor (42) having a reciprocating link (43) driven by an offset crankshaft (44). In this embodiment, the link transfers motion to the locking slide (16) and locking slide pin (19). An example of this embodiment is illustrated within FIG. 25. In a second alternative embodiment illustrated within FIG. 26, the linear solenoid (17) may be substituted with a linear leadscrew motor (45) which transfers linear motion to the locking slide (16) and locking slide pin (19). In a third alternative embodiment illustrated within FIG. 27, the solenoid may be replaced with a bimetal spring (46) that expands with the application of heat. Upon expansion, the bimetal spring applies linear motion to the locking slide (16) and locking slide pin (19).

According to further aspects of the present teaching, the push-to-open latch (1) also incorporates a rotating cam switch (25) and a locking slide switch (26) that are independently actuated by rotating cam ramp (27) and a locking slide ramp (28). These features are best illustrated within FIGS. 7, 19, 20, and 28 through 31. The rotating cam switch (25) and the locking slide switch (26) are designed to provide position signals of components of the push-to-open latch (1) to the oven controller (20). For example, when the oven door (5) is closed, a rotating cam switch button (30) positioned above the rotating cam (2) is depressed by a rotating cam ramp (27) positioned on the exterior surface of the rotating cam (2). When the rotating cam switch button is depressed, it sends a signal to the oven controller (20) indicating that the oven door (5) is in a locked configuration. Once the oven door controller receives this signal indicating that the oven door (5) is locked, the oven controller (20) will subsequently allow the self-cleaning function or other operational procedure to be activated. After the self-cleaning function or operational procedure is activated, the oven door controller (20) will transmit a signal to the linear solenoid (17) to momentarily actuate its plunger (31) to move the locking slide (16) and its pivoting toggle (23) into the lock-on position. Upon moving the locking slide (16) to a locked configuration which allows the locking pin (19) to engage the cam (2), a locking slide switch button (32) is depressed by a locking slide ramp (28) positioned to engage the locking slide switch button (32). Thus, as the rotating cam ramp (27) rotates, the rotating cam ramp (27) will contact and depress the rotating cam switch button (30). Further, as the locking slide (16) moves, the locking slide ramp (28) will contact and depress the locking slide switch button (32). Once the locking slide switch (26) is activated, a signal is transmitted to the oven controller (20) that the oven door (5) is securely locked and that the self-clean heating function can proceed for a programmed period of time. At the end of the self-clean period and after a programmed cooling period, the oven controller (20) energizes the linear solenoid (17) to momentarily actuate its plunger (31) to move the locking slide (26) and the pivoting toggle (23) into a lock-off position to disengage the locking slide pin (19) from the locking slot (22) of the rotating cam (2). The push-to-open latch (1) at this point will be ready to perform its "push-to-open" function and release the latching finger (7) and the pawl (4) from the rotating cam (2).

Figure 32:
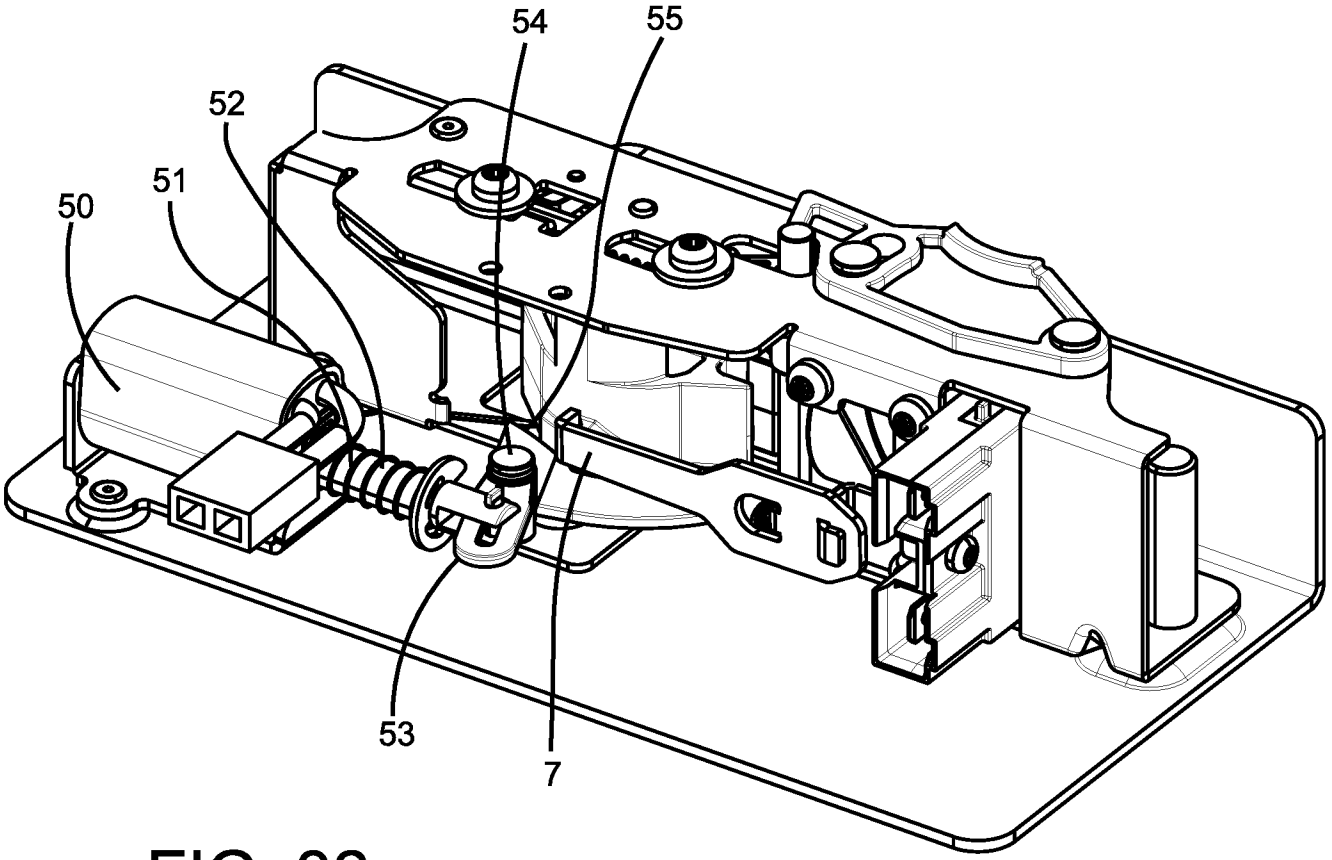
FIGS. 32 and 33 are perspective views of a signal-to-open operating system within the push-to-open/signal-to-open latching system.
Figure 33:
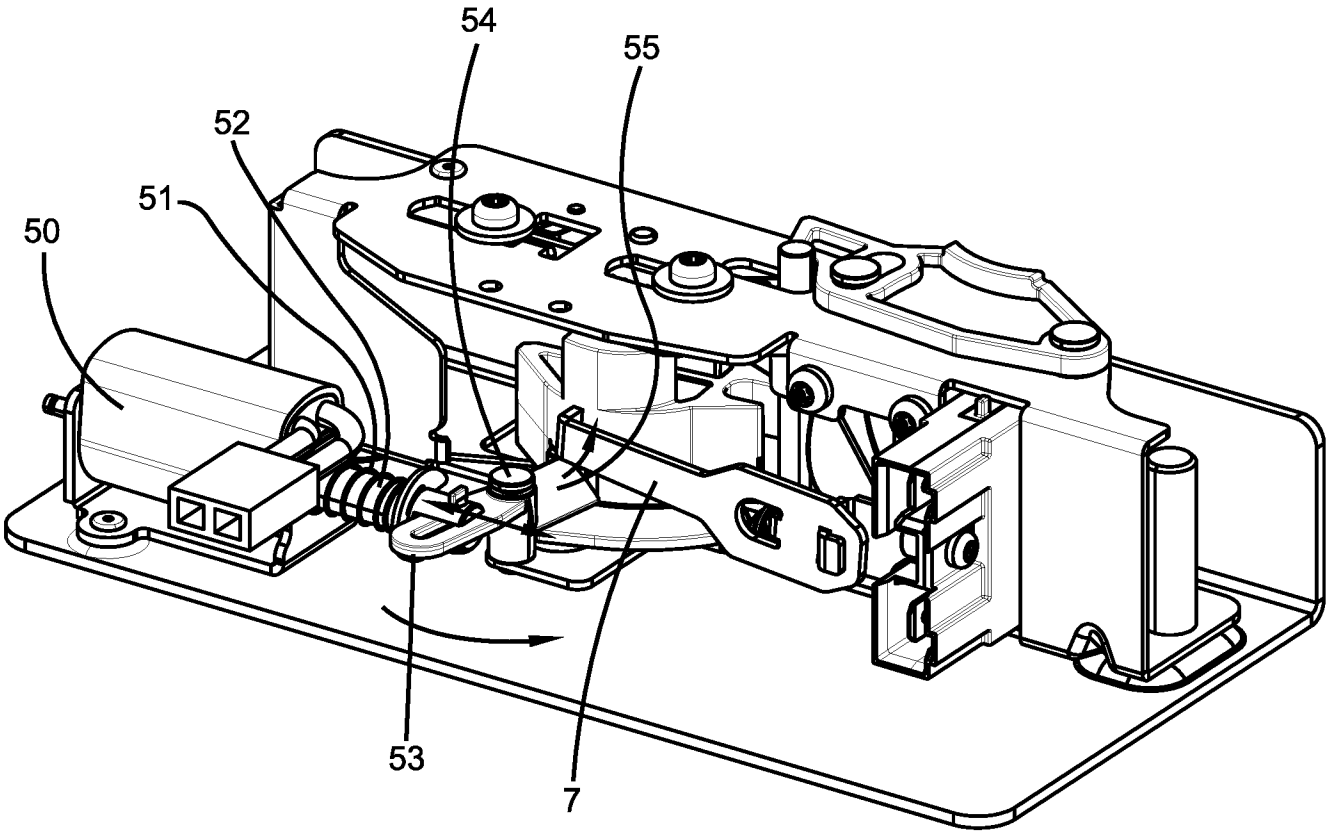

According to further aspects of the present teaching, the push-to-open latch (1) also incorporates a signal-to-open system. The signal-to-open system includes a solenoid (50) which is equipped with a linear plunger (52) and a return spring (51). The linear plunger has a first proximate end towards the solenoid and a second distal end away from the solenoid. The solenoid is capable of adjusting the linear plunger to an extended position and a retracted position. To assist returning the linear plunger to a retracted position, the linear plunger is equipped with a return spring around its shaft. The second end of the linear plunger is connected to a pivoting cam. The pivoting cam includes a first end connected to the linear plunger and a second end in contact with the latching finger (7). According to further aspects of the present disclosure, the second end of the linear solenoid is connected to a connecting slot having a first side and a second side and the first end of the pivoting cam includes a slot within its interior portion. The first side and second side of the connecting slot also each include an aperture for receiving a pin. In this embodiment, the connecting slot and the first end of the pivoting cam are transversely oriented or perpendicular with respect to each other along an axis line so that the first end of the pivoting cam and the connecting slot can be fitted together forming a link. The link is secured by inserting the pin through the aperture on the first side of the connecting slot, through the slot within the first end of the pivoting cam and through the aperture on the second side of the connecting slot. The signal-to-open solenoid (50) may be activated a number of different ways through its electrical terminal (72) by a control signal. Technologies such as a touch pad, push button or switch (77) or other such similar input within the purview of a person of ordinary skill in the art (including but not limited to a motion sensor, a remote control, voice command input, etc.) may be used to communicate the control signal to the signal-to-open solenoid to activate the linear plunger (52). The linear plunger (52) is connected to a pivoting cam (53) which pivots on a pivot shaft (54). At the opposite end of the pivoting cam (53) is a sloped surface (55) which pivots through a path that will engage the latching finger (7) of the push-to-open latch (1). The contact and pivoting motion of the sloped surface (55) against the edge of the latching finger (7) induces a motion on the latching finger (7) in a direction that will dislodge the latching finger (7) from the device's latching cam catch surface (12) allowing the door (5) to be released to an open position. This is best demonstrated by FIGS. 20, 32 and 33. This signal-to-open feature may be used as a substitute to the push-to-open feature.

According to further aspects of the present teaching, the push-to-open latch (1) also incorporates a manual override cam (60) which has a hole at one end that is pivotally affixed to a pivot pin (62) and has a slot at the opposite end that is guided by a slot pin (63). At the end furthest from the pivot, the manual override cam (60) has a sloped side (61) which travels through a path that will contact the locking slide pin (19). The manual override cam (60) also has a curved surface (64) at its front end. The curved surface (64) provides an operator with a surface to push the override cam (60) to rotate the cam along the pivot pin (62). Thus, the curved surface (64) allows an operator to manually rotate the override cam (60). This may be accomplished by an operator contacting the curved surface (64) and pushing the override cam (60) with an object such as a knife that fits within a slot within the body, frame or door of the appliance. As the manual override cam moves, the sloped side (61) will contact the locking slide pin (19) and induce linear travel on the locking slide pin (19). The linear motion will disengage toggle leg (23*b*) of the pivoting toggle (23) from its niche (41) in toggle housing (24) and allow the slide biasing spring (21) to reverse the motion and move locking slide (16) and locking pin (19) out of the cam slot (22), allowing the push-to-open or signal-to-open functions to operate. The reversed motion of locking pin (19) will also induce force on the sloped side (61) of the manual override cam (60) thus pivotally rotating it to a neutral position. This is best illustrated within FIG. 34 and FIGS. 35 to 38.

According to further aspects of the present teaching, the rotating cam switch (25) may include a secondary function to control the on-off mode of an oven light (not shown) within the oven cavity (34) when the oven door (5) is opened and/or closed by the user. By integrating operation of the door light switch with the latch, the latching system eliminates the need for a plunger which protrudes from oven to contact the door and activate or de-activate the light.

According to further aspects of the present teaching, the rotating cam switch (25), the locking slide switch (26), the signal-to-open solenoid (50), and the linear solenoid (17) may include electrical terminals which are grouped and orientated together for an appliance wiring harness (not shown). This is best illustrated within FIG. 20, where the rotating cam switch (25) and corresponding electrical terminal (70), the locking slide switch (26) and corresponding electrical terminal (71), the signal-to-open solenoid (50) and corresponding electrical terminal (72), and the linear solenoid (17) and corresponding electrical terminal (73) are all shown. In addition, a guiding sleeve (37) may be used to partially enclose the grouped terminals of electrical terminal (70) for the rotating cam switch (25), electrical terminal (71) for the locking slide switch (26) and electrical terminal (73) for the linear solenoid (17). This guiding sleeve (37) may include protruding chamfered edges to align and ease installation of a mating wire harness connector (not shown) onto the grouped terminals of the rotating cam switch (25), the locking slide switch (26) and the linear solenoid (17).

Also provided is a method of operating a push-to-open oven door latching and integrated locking system having a signal-to-open system and a manual override system. In summary, the method includes the following steps. First, an operator closes an oven door causing the pawl to contact the rotating cam and to rotate the rotating cam to a closed position. Upon rotation of the rotating cam to the closed position, the latching finger engages the catch surface on the rotating cam to lock it into position. The rotating cam switch then sends an electrical signal to the controller indicating that the door is now closed. The controller in turn sends a signal to shut off operation of the interior light of the appliance and a signal to the linear solenoid to extend the locking slide within the locking slot with the rotating cam to lock the door shut. Since the pivoting toggle is connected to the locking slide, extension of the locking slide to the locked position also results in movement of the pivoting toggle from the lock-off position to the lock on position. Once the locking slide is positioned within the locking slot of the rotating cam, the locking slide switch provides a position signal to the controller that the door is securely locked. After completion of the self-clean function and after a predetermined amount of cool-down time, the controller momentarily activates the linear solenoid which disengages the pivoting toggle and thus releases the locking slide from the cam so that normal cooking operations may commence with normal door opening and closing events.

The process for opening the appliance door may be initiated by an operator pushing the appliance door to open it (e.g., push-to-open function), by an operator engaging a signal button, by an operator issuing an audible command with his or her voice to activate a voice-activated signal or by an operator providing movement to activate a motion-activated signal (e.g., signal-to-open function). Upon opening the appliance door, a signal is sent by the rotating cam switch to the controller indicating the appliance door is open and the controller in turn sends a signal to illuminate the light within the interior space of the appliance. The signal-to-open function and the push-to-open function are both ways to open an appliance or oven door during cooking operations. In certain embodiments, appliances and ovens with mechanisms disclosed herein which provide for signal-to-open and push-to-open functions of latches will not have handles to pull open the appliance or oven door. In further embodiments, mechanisms related to the push-to-open and signal-to-open functions provide the only way to open the appliance or oven door.

While the apparatus and method for the push-to-open oven door latching system with an integrated locking device has been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the apparatus and method for the push-to-open oven door latching system with an integrated locking device should not be limited to any single embodiment, but rather construed in breadth and scope in accordance with the recitations of the appended claims. The right to claim elements and/or sub-combinations that are disclosed herein as other inventions in other patent documents is hereby unconditionally reserved.

What is claimed is:

1. A push-to-open/signal-to-open latching and integrated locking system for a door connected to an appliance comprising:

an appliance door supported on an appliance by a hinge, wherein the appliance door may be adjusted between an open position and a closed position to allow access to an appliance cavity and wherein the appliance door includes a pawl;

a push-to-open latch/signal-to-open and locking device connected to the appliance which is capable of engaging the pawl on the appliance door, a controller which is electrically connected to the push-to-open latch and locking device;

wherein the push-to-open latch and locking device comprises:

a latch mounting bracket comprising a flat planar surface and a vertical side edge;

a carriage frame connected to the flat planar surface of the latch mounting bracket, wherein the carriage frame comprises a bottom surface, a side surface, a top surface having a top end and a bottom end;

a rotating cam having an exterior surface connected to the latch mounting bracket and rotatable with respect to the latching mounting bracket, wherein the rotating cam comprises:

a latching slot integrated within the exterior surface for engaging the pawl;

a guiding ramp on the exterior surface of the rotating cam;

a catch surface;

a secondary ramp;

a latching finger having a first end which is attached to the carriage frame and a second end having a projection, wherein the second end of the latching finger is capable of being lifted by the secondary ramp upon rotation of the rotating cam in a first direction when a user engages the rotating cam with the pawl, wherein complete rotation of the rotating cam in the first direction results in the secondary ramp engaging the catch surface of the rotating cam, wherein the latching finger may be released from the catch surface by a user pushing in the appliance door near the push-to-open latch to induce rotation of the rotating cam in a second opposite direction, wherein rotation of the rotating cam in the second direction guides the latching finger to the secondary ramp and results in lifting the latching finger to release the latching finger from the catch surface;

a linear solenoid positioned on the bottom surface of the carriage frame adjacent to the rotating cam;

a locking slide positioned on the bottom end of the top surface of the carriage frame;

slots within the top surface of the carriage frame which allow the locking slide to travel between a retracted position and an extended position;

a locking pin extending downward from the locking slide between the solenoid and the rotating cam;

a locking slot integrated within the exterior surface of the rotating cam, wherein activation of the solenoid induces a force upon the locking slide causing the locking slide to travel to the lock-on position within the slot and causing the locking slide pin to engage the locking slot of the rotating cam; and a pivoting toggle connected to the locking slide, wherein the pivoting toggle may alternately toggle between a lock-on position and a lock-off position with linear movement of the locking slide between the retracted position and the extended position.

2. The push-to-open/signal-to-open latching and integrated locking system of claim 1, wherein the pivoting toggle is supported by a pivot support which is rigidly attached to the carriage frame.

3. The push-to-open/signal-to-open latching and integrated locking system of claim 2, wherein the locking slide comprises toggle guide surfaces which direct movement of the pivoting toggle and two crescent niches to engage a toggle leg and hold the locking slide in lock-on and lock-off positions.

4. The push-to-open/signal-to-open latching and integrated locking system of claim 3, further comprising a rotating cam switch and a locking slide switch which are independently actuated by a rotating cam ramp integrated within an exterior planar surface of the rotating cam and a locking slide ramp integrated within the locking slide.

5. The push-to-open/signal-to-open latching and integrated locking system of claim 4, wherein the rotating cam switch provides a position signal to the controller when the door is closed.

6. The push-to-open/signal-to-open latching and integrated locking system of claim 5, wherein the locking slide switch provides a position signal to the controller that the door is securely locked upon movement of the locking slide within the locking slot of the rotating cam.

7. The push-to-open/signal-to-open latching and integrated locking system of claim 6, wherein the rotating cam switch controls operation of a light within an interior cavity of the appliance when the door is opened or closed by the user.

8. The push-to-open/signal-to-open latching and integrated locking system of claim 7, wherein the rotating cam switch, locking slide switch and linear solenoid each include electrical terminals which are connected to a wiring harness.

9. The push-to-open/signal-to-open latching and integrated locking system of claim 8, wherein the locking slide comprises a slide biasing spring which is compressed within the slide against a flange attached to the carriage frame and controls the position of both the pivoting toggle and the locking pin.

10. The push-to-open/signal-to-open latching and integrated locking system of claim 9, wherein the electrical terminals of the rotating cam switch, the locking slide switch and the linear solenoid are contained within a corresponding guiding sleeve.

11. The push-to-open/signal-to-open latching and integrated locking system of claim 10, wherein the guiding sleeve comprises protruding chamfered edges to align and ease installation of a mating wire harness connector onto the grouped terminals of the rotating cam switch and the locking slide switch.

12. The push-to-open/signal-to-open latching and integrated locking system of claim 11, wherein the system further comprises a signal-to-open solenoid for deactivating the latching finger, wherein the solenoid is connected to a linear plunger having a first end towards the solenoid and a second end away from the solenoid, wherein the solenoid is capable of adjusting the linear plunger to an extended position and a retracted position, wherein the linear plunger is surrounded by a return spring which assists in pulling the linear plunger to the retracted position and wherein the linear plunger is connected to a pivoting cam wherein the pivoting cam comprises a first end connected to the linear plunger and a second end in contact with the latching finger.

13. The push-to-open/signal-to-open latching and integrated locking system of claim 12, wherein the second end of the linear solenoid is connected to a connecting slot having a first side and a second side, wherein the first end of the pivoting cam comprises a slot formed within the interior portion of the first end of the pivoting cam, wherein the connecting slot and the first end of the pivoting cam are transversely oriented with respect to each other along an axis line, wherein the first side of the connecting slot and the second side of the connecting slot comprises an aperture for receiving a pin, wherein the connecting slot and the first end of the pivoting cam are connected to each other to form a linked connection by a pin which is inserted through the aperture on the first side of the connecting slot, through the slot within the first end of the pivoting cam and through the aperture on the second side of the connecting slot.

14. The push-to-open/signal-to-open latching and integrated locking system of claim 13, wherein the second end of the pivoting cam comprises a sloped surface opposite the first end of the pivoting cam wherein the sloped surface at the second end of the pivoting cam lifts the latching finger away from the catch surface as the linear plunger extends to rotate the pivoting cam to dislodge the latching finger from the latching cam.

15. The push-to-open/signal-to-open latching and integrated locking system of claim 13, wherein operation of the linear solenoid is controlled automatically by the controller of the appliance upon completion of an appliance function.

16. The push-to-open/signal-to-open latching and integrated locking system of claim 15, wherein the system further comprises a manual override cam, wherein the manual override cam is pivotally affixed to a pivot pin at a first end and comprises a slot at a second end opposite of the first end guided by a slot pin and a sloped surface at the second end adjacent to the slot, wherein the sloped surface engages the locking slide pin to induce linear movement of the locking slide pin as the manual override cam rotates causing the locking slide pin to move out from the locking slide slot of the rotating cam to unlock the system and allow the push-to-open latch and signal-to-open solenoid to operate.

17. The push-to-open/signal-to-open latching and integrated locking system of claim 16, wherein the manual override cam is affixed to the top surface of the carriage frame by the pins of claim 16.

18. The push-to-open/signal-to-open latching and integrated locking system of claim 17, wherein the manual override cam comprises a curved surface at its front end, wherein access to the curved surface is provided by a slot within the frame, door or body of the appliance, wherein an operator by contact the curved surface by inserting an object within the frame, door or body of the appliance to cause the manual override cam to rotate to release the locking sliding pin from the locking sliding slot of the rotating cam.

* * * * *